US007331073B2

(12) United States Patent
Littlehorn et al.

(10) Patent No.: US 7,331,073 B2
(45) Date of Patent: Feb. 19, 2008

(54) BACK SUPPORT ATTACHMENT FOR NURSING PILLOWS

(75) Inventors: Sheila Littlehorn, Littleton, CO (US); Elizabeth A. Franqui, Golden, CO (US)

(73) Assignee: The Boppy Company, Golden, CO (US)

( * ) Notice: Subject to any disclaimer, the term of this patent is extended or adjusted under 35 U.S.C. 154(b) by 100 days.

(21) Appl. No.: 11/169,600

(22) Filed: Jun. 28, 2005

(65) Prior Publication Data

US 2005/0278853 A1 Dec. 22, 2005

Related U.S. Application Data

(63) Continuation-in-part of application No. 11/120,694, filed on May 2, 2005, which is a continuation-in-part of application No. 10/612,266, filed on Jul. 1, 2003, now Pat. No. 6,944,898.

(51) Int. Cl.
*A47G 9/00* (2006.01)

(52) U.S. Cl. ..... 5/655; 5/657; 5/652; 5/632

(58) Field of Classification Search ..... 5/632, 5/633, 640, 631, 630, 636, 653, 655, 657, 5/652, 930
See application file for complete search history.

(56) References Cited

U.S. PATENT DOCUMENTS 682,871 A 9/1901 Hogan et al.
941,043 A * 11/1909 Powell ..... 5/640
1,343,357 A 6/1920 Eggers
1,386,652 A * 8/1921 Patton ..... 5/640
1,986,697 A * 1/1935 Wilson ..... 5/630
2,328,871 A 9/1943 Woehler
2,765,480 A * 10/1956 Mueller ..... 5/640
2,952,856 A * 9/1960 Ruff ..... 5/640
2,961,668 A 11/1960 Hayes
3,667,074 A 6/1972 Emery
3,848,281 A 11/1974 Mathews
3,911,512 A * 10/1975 Plate ..... 5/652

(Continued)

FOREIGN PATENT DOCUMENTS

DE 42 05 650 A1 11/1993

(Continued)

OTHER PUBLICATIONS

Leachco Adjustable Nursing Pillow, http://store.yahoo.com/leachco/naturalboost.html, May 16, 2005.

(Continued)

*Primary Examiner*—Robert G. Santos
(74) *Attorney, Agent, or Firm*—Townsend and Townsend and Crew LLP

(57) ABSTRACT

A pillow system comprises a curved main pillow having a pillow body having a midsection and a pair of ends. The pillow body is curved and is both flexible and firm to permit it to wrap around a user. A curved lower back pillow is operably attached to one of the ends of the main pillow such that the back pillow is positionable at the user's back when the main pillow is placed adjacent to the user's stomach.

19 Claims, 14 Drawing Sheets

U.S. PATENT DOCUMENTS

| | | | | | |
|---|---|---|---|---|---|
| 3,920,239 | A | | 11/1975 | White | |
| 4,161,794 | A | | 7/1979 | Darnfors | |
| 4,197,604 | A | | 4/1980 | Nakamura | |
| D255,966 | S | | 7/1980 | Stadel | |
| 4,227,270 | A | | 10/1980 | Rivera | |
| 4,236,264 | A | | 12/1980 | Britzman | |
| 4,345,347 | A | | 8/1982 | Kantor | |
| 4,394,783 | A | * | 7/1983 | Simmons | 297/230.1 |
| 4,397,052 | A | * | 8/1983 | Lund, III | 5/631 |
| 4,434,513 | A | | 3/1984 | Welch | |
| 4,506,396 | A | * | 3/1985 | Ritchie et al. | 5/631 |
| 4,617,691 | A | * | 10/1986 | Monti et al. | 5/640 |
| 4,731,890 | A | | 3/1988 | Roberts | |
| 4,858,259 | A | | 8/1989 | Simmons et al. | |
| D315,845 | S | | 4/1991 | Lafley | |
| 5,029,350 | A | | 7/1991 | Edelson | |
| D318,969 | S | | 8/1991 | Byrn | |
| 5,054,142 | A | * | 10/1991 | Owens | 5/633 |
| 5,056,533 | A | | 10/1991 | Solano | |
| 5,103,516 | A | * | 4/1992 | Stevens | 5/640 |
| 5,134,740 | A | | 8/1992 | Summer | |
| 5,154,649 | A | | 10/1992 | Pender | |
| 5,182,828 | A | * | 2/1993 | Alivizatos | 5/631 |
| 5,193,235 | A | | 3/1993 | Kircher | |
| 5,257,429 | A | | 11/1993 | Genis | |
| 5,261,134 | A | | 11/1993 | Mathews | |
| 5,313,678 | A | | 5/1994 | Redewill | |
| D348,174 | S | | 6/1994 | Genis | |
| D352,633 | S | | 11/1994 | Berggren | |
| D360,554 | S | | 7/1995 | Righini | |
| 5,519,906 | A | | 5/1996 | Fanto-Chan | |
| 5,546,620 | A | | 8/1996 | Mathews | |
| 5,581,833 | A | | 12/1996 | Zenoff | |
| D377,881 | S | | 2/1997 | Watt | |
| 5,661,861 | A | | 9/1997 | Mathews | |
| 5,664,271 | A | * | 9/1997 | Bellavance | 5/632 |
| 5,702,153 | A | | 12/1997 | Pliska | |
| D393,772 | S | | 4/1998 | Vingino | |
| 5,790,999 | A | | 8/1998 | Clark | |
| D416,159 | S | | 11/1999 | Porter | |
| 5,979,981 | A | | 11/1999 | Dunne et al. | |
| 6,038,720 | A | | 3/2000 | Mathews et al. | |
| 6,047,420 | A | * | 4/2000 | Priester et al. | 5/632 |
| 6,052,848 | A | | 4/2000 | Kelly | |
| 6,055,687 | A | | 5/2000 | Mathews | |
| 6,233,767 | B1 | | 5/2001 | Horowitz | |
| 6,279,185 | B1 | | 8/2001 | Mathews | |
| 6,321,403 | B1 | | 11/2001 | Mathews | |
| 6,354,665 | B1 | | 3/2002 | Ross | |
| 6,412,128 | B1 | | 7/2002 | Mathews | |
| 6,434,770 | B2 | | 8/2002 | Mathews Brown | |
| 6,453,493 | B1 | | 9/2002 | Mathews Brown | |
| 6,484,337 | B1 | * | 11/2002 | Moe et al. | 5/652 |
| 6,487,737 | B1 | | 12/2002 | Futagami | |
| 6,523,200 | B2 | | 2/2003 | Brown | |
| 6,532,612 | B2 | | 3/2003 | Mathews Brown | |
| 6,553,590 | B1 | | 4/2003 | Leach | |
| 6,564,408 | B2 | | 5/2003 | Van Vuuren | |
| 6,625,828 | B2 | | 9/2003 | Brown | |
| 6,651,282 | B1 | | 11/2003 | Skoug et al. | |
| 6,658,681 | B2 | | 12/2003 | Britto et al. | |
| 6,708,354 | B1 | * | 3/2004 | Carter et al. | 5/632 |
| 6,711,770 | B1 | | 3/2004 | Owens et al. | |
| 6,754,924 | B1 | * | 6/2004 | Brady et al. | 5/655 |
| 6,842,925 | B1 | | 1/2005 | Owens et al. | |
| D503,062 | S | | 3/2005 | Nash | |
| 6,886,201 | B1 | * | 5/2005 | Weiss-Lohrei | 5/631 |
| 6,944,898 | B2 | * | 9/2005 | Matthews Brown et al. | 5/655 |
| 2002/0014436 | A1 | | 2/2002 | Mathews Brown | |
| 2007/0056110 | A1 | * | 3/2007 | Tuoriniemi et al. | 5/655 |

FOREIGN PATENT DOCUMENTS

| | | | |
|---|---|---|---|
| EP | 1 306 034 | A1 | 5/2003 |
| FR | 1.430.355 | | 1/1966 |
| FR | 2 379 268 | | 9/1978 |
| GB | 215848 | | 5/1924 |
| GB | 1 508 809 | | 4/1978 |
| GB | 2 198 341 | A | 6/1988 |
| GB | 2 205 236 | A | 12/1988 |
| WO | WO 02/21978 | A2 | 3/2002 |
| WO | WO 02/21979 | A1 | 3/2002 |
| WO | WO 02/28232 | A1 | 4/2002 |

OTHER PUBLICATIONS

Leachco, Positional Nursing Pillow, http://store.yahoo.com/leachco/13560.html, May 16, 2005.

Leachco Infant Support Cushion, http:/;/store.yahoo.com/leachco/lecuddler.html, Apr. 20, 2005.

Baby Supercenter, Deluxe Nurse 'N Play Pillow, http://www.babysupercenter.com/cgi-bin/webc.cgi/st_prod.html?p_prodid=13407&p_catid=&sid=5dy8u., Apr. 20, 2005.

Parents of Invention, Nurse n' Sleep, http://www.parentsofinvention.com/products/NurseSleep.htm., Apr. 20, 2005.

Simplicity for Children, Hugger with Vibration, http://www.simplicityforchildren.com/ourproducts/nursingpillows/9300PGH.htm, Apr. 20, 2005.

Touch For Life, Regular Hugster, http://www.touchforlife.biz/products/family/hugster.html, Apr. 20, 2005.

Luvee Baby Products, The Luvee Nursing Pillow, http://www.theluvee.com/, Apr. 20, 2005.

Luvee Baby Products, Nursing Pillow, http://www.theluvee.com/benefits.htm, Apr. 20, 2005.

My Brest Friend, Nursing Pillow, http://www.mybrestfriend.com/features.html, Apr. 20, 2005.

Peaceful Pea, The Nursing Nest, http://www.peacefulpea.com/nursing_nest.html, Apr. 20, 2005.

Pregnancy Store, Kozy Kushion Nursing Pillow, http://www.pregnancystore.com/kozy_kushion.htm, May 18, 2005.

* cited by examiner

BACK SUPPORT ATTACHMENT FOR NURSING PILLOWS

CROSS-REFERENCES TO RELATED APPLICATIONS

This application is a continuation in part and claims priority from U.S. application Ser. No. 11/120,694, filed May 2, 2005, which is a continuation in part of U.S. application Ser. No. 10/612,266 now U.S. Pat. No. 6,944,898; filed Jul. 1, 2003, the complete disclosures of which are herein incorporated by reference.

BACKGROUND OF THE INVENTION

This invention relates generally to the field of pillows, and in particular to pillows that may be used to support various items. More specifically, the invention relates to pillows that may rest on a user's lap to help support the items, as well as supporting a user's lower back.

Pillows have a wide variety of uses. For example, pillows are used almost universally when sleeping to support the head. Pillows may also be used to support other things as well. One example of such a pillow is the Boppy® support pillow, commercially available from The Boppy Company. Examples of such pillows are also described in U.S. Pat. Nos. 5,261,134 and 5,661,861, the complete disclosures of which are herein incorporated by reference. One use for these pillows is to use the open well to support a baby or to be placed around a user.

This invention relates to other pillows having a wide variety of uses. These pillows are described more fully hereinafter.

BRIEF SUMMARY OF THE INVENTION

In one embodiment, the invention provides a pillow that comprises a pillow body having a midsection and a pair of ends. The pillow body is curved and has an average radius of curvature that is in the range from about 6 inches to about 16 inches. The pillow also has a length in the range from about 21 inches to about 42 inches. The pillow body is firm enough to support items while being sufficiently flexible to allow the pillow to be shaped around an object, such as the waist or stomach of a user.

The pillow may be used by placing the pillow on a user's lap. In so doing, the midsection may rest on the user's legs while being adjacent to the user's stomach. The curved pillow body permits the pillow to wrap about the user so that the ends are adjacent the user's sides. The radius of curvature is selected so that the pillow may conform to a wide variety of users of different sizes. By selecting an appropriate radius of curvature, the ends are spaced sufficiently far apart so that the pillow can fit around the user while also closely conforming to the user.

The pillow body may be constructed in a variety of ways. For example, the pillow body may comprise a fill material that is encased in a fabric cover. As another example, the pillow body may comprise an inflatable bladder. In one aspect, the pillow may also have a removable slip cover. The slip cover may have an opening to permit it to be placed over the pillow. A fastener, such as a zipper, may be used to close the opening.

In one aspect, the midsection of the pillow body may have an average width that is in the range from about 5 inches to about 10 inches, and an average height in the range from about 4 inches to about 9 inches. The ends may be rounded and may have an average width in the range from about 3 inches to about 10 inches and an average height in the range from about 1 inch to about 9 inches. The ends may also be spaced apart by a distance in the range from about 14 inches to about 28 inches.

One advantage of the pillow is that the ends may be manipulated so that they fit between the arms of a chair and the user's sides. In this way, the pillow may conveniently be used when sitting in a chair.

The pillow may also be used to support a variety of items. For example, the pillow may be used to hold a baby, such as when nursing or bottle feeding the baby, or simply to help hold the baby. Other examples include the holding of books, food, crafts and the like.

In some embodiments, a padded attachment member may be removably attached to the pillow to adjust the vertical height of the pillow. For example, the attachment member may be attached to the bottom side of the pillow and rest on a user's lap to elevate the top side of the pillow. Alternatively, the attachment member may be attached to the top side of the pillow. In this way, the same pillow may be adapted to people of different sizes or for different applications, such as when nursing a baby that rests on the pillow and/or the attachment member.

The attachment member may be attached to only a portion of the pillow body or to the entire pillow. For example, the attachment member may be attached to only one end or arm to slant or angle the pillow on a user's lap. In some cases, the attachment member may have a shape that is similar to some or all of the pillow, or in some cases, the entire pillow, such as one of the arms. Also, the attachment member could be folded over on itself to enable it to rest against all or only half of the pillow. In some cases, the attachment member may have a height in the range from about 1 inch to about 5 inches to adjust the height of the pillow. This height may be uniform over the length of the attachment member or may vary across the length.

A variety of coupling arrangements may be used to couple the attachment member to the pillow. For example, the coupling arrangement could be part of the attachment member and be configured to wrap around the pillow and attach to itself. As another option, the coupling arrangement could be part of the attachment member and the pillow. For instance, the attachment member may have one connector while the pillow has a mating connector. Such connectors could include snaps, buttons, loops, ties, clips and the like.

Any of the pillows and/or attachment members described herein may be used in combination with one or more lower back pillows that are used to support the user's lower back. Such lower back pillows may be permanently or removably attached to one of the ends of the main pillow body. In this way, the main pillow may rest on a user's lap, with the lower back pillow being adjacent to the user's lower back.

DETAILED DESCRIPTION OF THE INVENTION

In one aspect, the pillows of the invention comprise a pillow body that is gently curved. The amount of curvature is selected so that the ends of the pillow are spaced enough apart to permit the pillow to be placed around individuals having a variety of sizes. The amount of curvature may be defined in terms of an "average" radius of curvature. This dimension represents the radius that is generated if an arc is drawn between a center point of the pillow body and the two ends. Because the pillow may not be fashioned according to a true geometric arc, the term "average" is used to indicate it is merely an approximation. Hence, the pillow bodies may be curved according to a true arc or other type of geometric curvature. Further, the pillow bodies may have a wide variety of shapes and other design features including rounded or curved edges or ends, tapered sides or ends, patterned edges, sloping or curved sections and the like.

The pillows of the invention may also be used in combination with one or more padded attachments and/or lower back support pillows. These may be removably attached to the main pillow or provided with various adjustments to permit the location or position of the attachment members and/or pillows to be adjusted.

Figure 1:
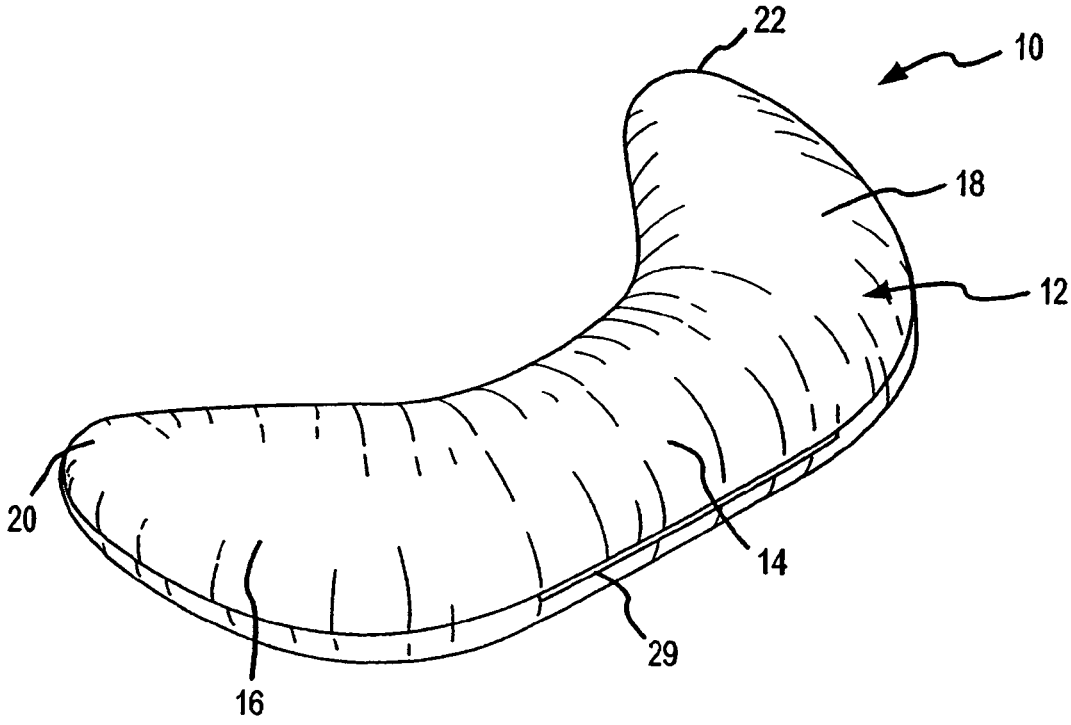
FIG. 1 is a front perspective view of an embodiment of a pillow according to the invention.
Figure 2:
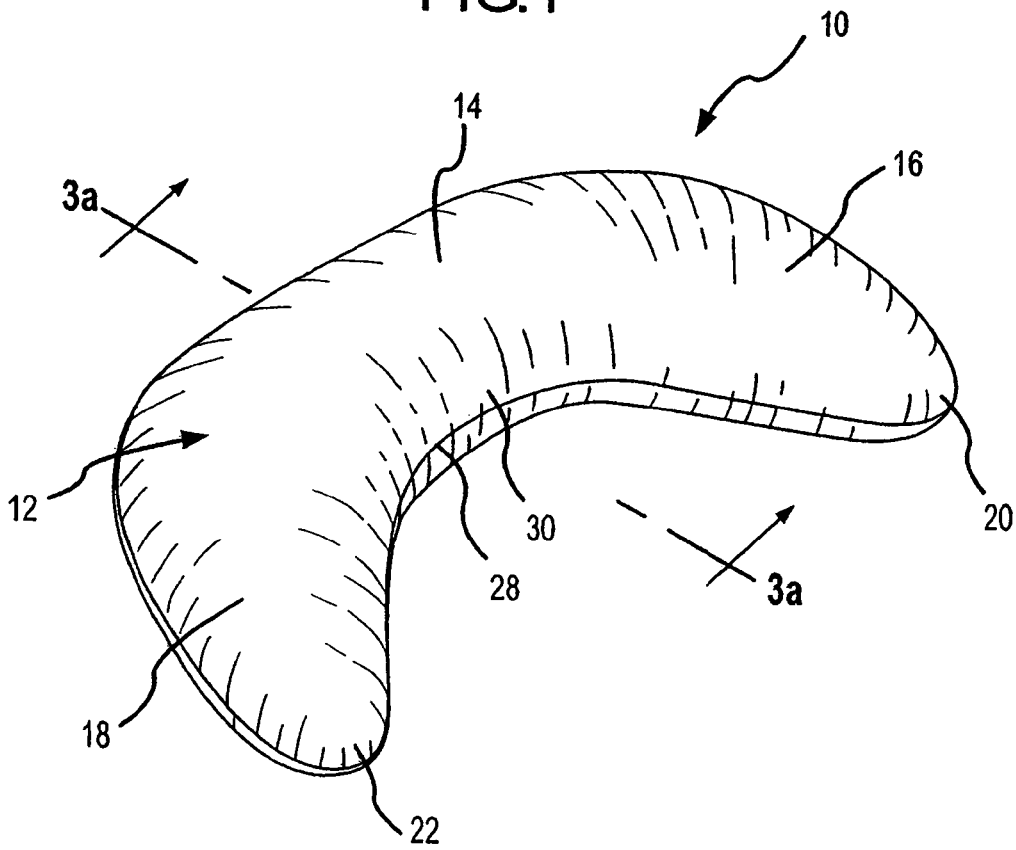
FIG. 2 is a rear perspective view of the pillow of FIG. 1.
Figure 3A:
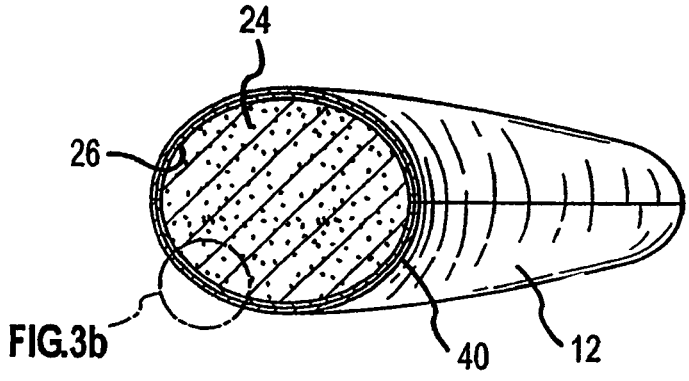
FIG. 3*a* is a cross sectional side view of the pillow of FIG. 1 with a removable slip cover.
Figure 3B:
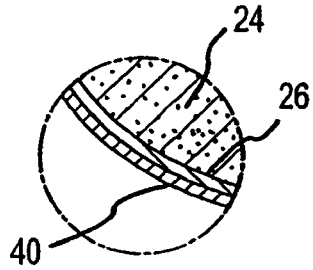
FIG. 3*b* is a more detailed view of the pillow of FIG. 3*a*.

Referring now to FIGS. 1 and 2, one embodiment of a pillow 10 will be described. Pillow 10 comprises a pillow body 12 having a midsection 14 and two end sections 16 and 18 that terminate in ends 20 and 22. As best shown in FIGS. 3*a* and 3*b*, pillow 10 may be constructed of a fill material 24 that is covered by a fabric cover 26. Examples of fill materials that may be used include resilient, compression resistant, hypoallergenic material, such as polyester fibers, and the like. Cover 26 may be any type of fabric such as cotton, nylon, LYCRA, denim, polyester and the like. Pillow body 12 may conveniently be constructed by sewing together two pieces of fabric along a center seam 28. The fill material 24 may be stuffed inside cover 26 to provide sufficient firmness so that pillow 10 generally does not sag or droop when held at midsection 14. This also provides sufficient firmness so that an item, object, baby or the like is supported without significant deflection or indentation of pillow body 12. Use of center seam 28 is also useful in that it helps the pillow body return to the shape shown in FIG. 1 if ends 20 and 22 are separated. For instance, if pillow 10 is placed around a larger individual, ends 20 and 22 may be pulled further apart. When released, seam 28 causes ends 20 and 22 to spring back to its original position. After stuffing the fill material within cover 26, the cover 26 may be closed by creating an exterior seam line 29. However, other techniques could be used as well. For example, a zipper could be used in place of an exterior seam.

It will be appreciated that various other techniques may be used to construct pillow 10. Merely by way of example, pillow 10 may be constructed using techniques similar to those described in U.S. Pat. Nos. 5,261,134; 5,661,861; 6,038,720; 6,055,687; 6,434,770; 6,352,612; 6,279,185; 6,412,128; 6,453,493; and 6,523,200; and in copending U.S. application Ser. No. 10/046,377, filed Oct. 26, 2001; Ser. No. 09,884,742, filed Jun. 18, 2001; Ser. No. 09/679,139, filed Oct. 3, 2000; Ser. No. 09/802,097, filed Mar. 8, 2001; Ser. No. 10/426,067, filed Apr. 28, 2003; and Ser. No. 10/612,267, filed Jul. 1, 2003. The complete disclosures of all these references are herein incorporated by reference.

Pillow 10 may have an average radius of curvature that permits it to conform to the shape of a person's torso while still having its ends separated enough so that it may fit around individuals of various sizes. The radius of curvature may be in the range from about 6 inches to about 16 inches, and more preferably from about 9 inches to about 11 inches. This may permit ends 20 and 22 to be separated by a distance in the range from about 14 inches to about 28 inches without stretching ends 20 and 22 apart. If pulled apart, the ends may separate several inches further. The distance from end 20 to end 22 through midsection 14 may be in the range from about 21 inches to about 42 inches, and more preferably from about 28 inches to about 36 inches. The distance from ends 20 and 22 to the inside of midsection 14 may be in the range from about 5 inches to about 11 inches, and more preferably from about 6 inches to about 7 inches. End sections 16 and 18 may have a length in the range from about 7 inches to about 15 inches, and more preferably from about 11 inches to about 13 inches. End sections 16 and 18 may also taper toward ends 20 and 22. The amount of taper may be in the range from about 10 inches to about 6 inches, and more preferably from about 8 inches to about 7 inches, near midsection 14 and taper to about 8 inches to about 3 inches, and more preferably from about 5 inches to about 4 inches, at ends 20 and 22. The height of midsection 14 may be in the range of about 9 inches to about 4 inches, and more preferably from about 7 inches to about 5 inches. This height may lessen along end sections 16 and 18 so that the height at ends 20 and 22 may be in the range from about 5 inches to about 1 inch, and more preferably about 3 inches. Midsection 14 may have a width in the range from about 10 inches to about 5 inches and more preferably from about 7 inches to about 8 inches, and a length in the range from about 12 inches to about 24 inches and more preferably from about 16 inches to about 20 inches.

Such dimensions permit pillow 10 to be used with children, teenagers and adults of various sizes. For example, when sitting down, inner side 30 would generally conform to the user's stomach and wrap around her sides. End sections 16 and 18 taper to permit them to fit between the arms of a chair and the user's side. Pillow 10 also has a height that permits a baby to sit on the pillow while breast feeding and to be positioned at an optimal height. A user's arms or elbows may also rest on pillow 10 to hold an item at about eye level. By having ends 20 and 22 wrap around the user's side, it facilitates supporting of the user's arms or elbows.

As shown in FIGS. 3*a* and 3*b*, a removable slip cover 40 may be placed over cover 26. Slip cover 40 may be constructed of a wide variety of fabrics, including any of those used for cover 26. Slip cover 40 may be configured to tightly conform to the shape of pillow 10 and may have one or more openings and one or more fasteners to permit pillow 10 to be inserted into cover 40 and then close cover 40. Cover 40 may also be used if pillow 10 is inflatable. Suitable types of slip covers are also described in U.S. Pat. No. 6,453,493 incorporated herein by reference.

Although not shown, it will be appreciated that other features may be added to pillow 10. For example, various toys or other items may be attached to or surrounded above pillow 10 as described in any of the references incorporated herein. Also a strap may extend between ends 20 and 22 to help hold pillow 10 about a user. As other examples, one or more pockets or other attachment members (such as straps) may be attached to pillow 10 to hold a variety of items, such as described in the references incorporated herein. As some specific examples, the pockets may be used to hold bottles, toys, burping cloths, and the like. Pillow 10 may also have one or more handles to help transport the pillow. Such handles may be similar to those described in references incorporated herein. Still further, pillow 10 may have a head member (such as an animal head) attached anywhere along the pillow, such as at one end. Examples of such head members are described in the references incorporated herein.

Pillow 10 may be packaged and stored using a variety of packing devices, purses or the like. Examples of such packages and bags are described in references incorporated herein and in copending U.S. application Ser. No. 09/884,742, filed Jun. 18, 2001, and Ser. No. 10/612,265, filed Jul. 1, 2003, incorporated herein by reference. Pillow 10 may also be displayed using any of the techniques or devices described in U.S. Pat. No. 6,119,873 incorporated herein by reference.

Figure 4:
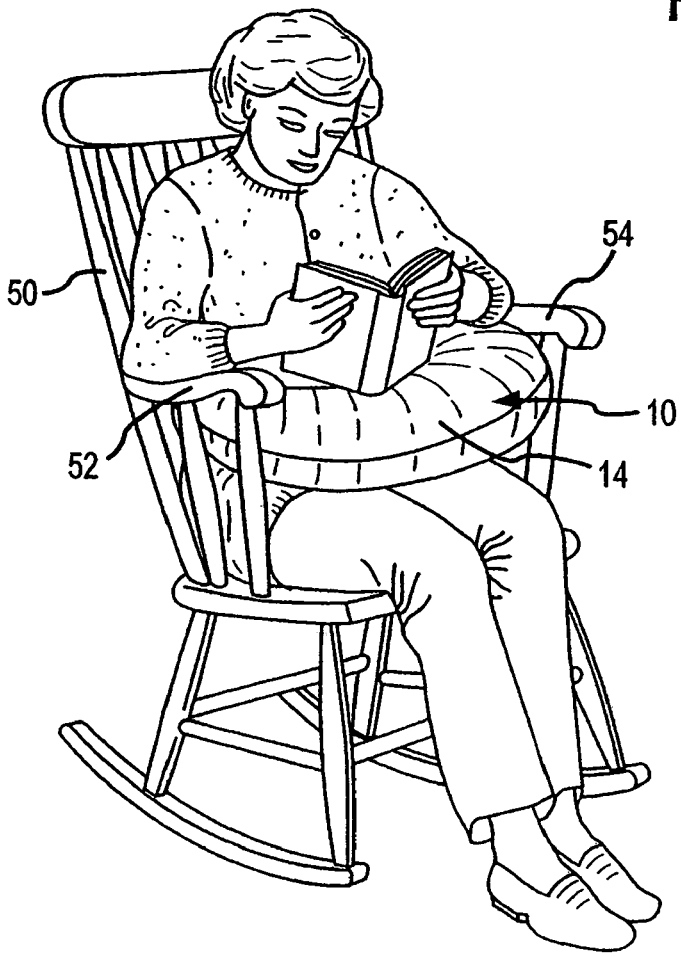
FIG. 4 illustrates the pillow of FIG. 1 when held in a user's lap according to the invention.

Referring now to FIG. 4, pillow 10 is shown resting on the lap of a user. The user is sitting in a chair 50 having a 'pair of arms 52 and 54. In this position, midsection 14 rests on the user's lap while end sections 16 and 18 wrap around the user's sides. Ends 20 and 22 fit between arms 52 and 54. In this way, a book or the user's elbows may rest on pillow 10. As another alternative, a baby may rest on pillow 10 while being fed or nursed. Examples of chairs having such arms include rocking chairs, wheel chairs, end chairs and the like. Other items that may be held include food, crafts, knitting, games, computers, phones and the like.

Further, it will be appreciated that a variety of other uses for pillow 10 exist. These may include, for example, as a back support, as a traditional pillow for the head, to prop up a baby or child, as a seat cushion or the like. As another example, the pillow may be used to support the legs or hips. For example, when a person is lying on his or her back, the pillow may be placed between the user's legs or knees and the ground. This permit's the person's legs to be propped up. As a further example, the pillow may be placed between the person's legs or knees while the person is lying on his or her side. As still another example, the pillow may be used as a back or front support when the person is lying on his or her side. For instance, for a pregnant woman, the pillow could be placed between the mother's stomach and the ground to help support the stomach. Other examples of how such a pillow may be used are described in any of the references incorporated herein.

A variety of attachment members may be coupled to any of the pillows described herein to modify or vary the height of the pillow. This may be done, for example, when there is a need to adjust the height of the top surface of the pillow relative to the user. For example, when the pillow is resting on a user's lap, such as when the pillow is being used to nurse an infant, the location of the top surface may be varied by attaching an attachment member to the pillow such that it rests between the pillow and the user's lap. In this way, if the baby's head needed to be lifted higher, this may be accomplished by providing the attachment member between the pillow and the mother's lap. The attachment member may be coupled to all of the pillow so as to adjust the height of the entire top surface of the pillow, or only be attached to a portion of the pillow so that only a portion of the top surface has its height adjusted. This arrangement may also configure the top surface of the pillow so that it is angled. In this way, the baby's head may be positioned higher than the rest of the baby's body. Also, a variety of coupling arrangements may be used to couple the attachment member to the pillow. For instance, the attachment member may have a coupling arrangement that is configured to wrap around the pillow and couple to itself. Alternatively, the coupling arrangement could be configured to engage a connector on the pillow to secure the attachment member to the pillow.

Figure 5:
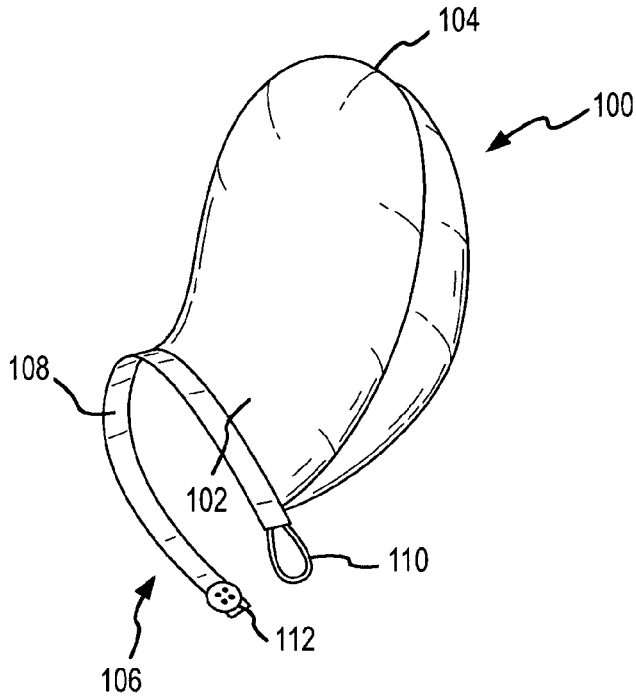
FIG. 5 is a perspective view of one embodiment of an attachment member for adjusting the vertical height of a pillow according to the invention.

FIG. 5 illustrates one embodiment of an attachment member 100. Attachment member 100 has an attachment end 102 and a curved end 104 that is intended to match the shape or curvature of one of the arms of the pillow. Attachment member 100 may be constructed of a fill material that is encased within a fabric cover or shell. Similarly, any of the techniques used to construct the pillow may also be used to construct attachment member 100. For example, attachment member 100 could alternatively be inflatable, or simply be a single piece of material, such as a polyurethane foam.

At attachment end 102 is a coupling arrangement 106 that comprises a belt 108 having a loop 110 at one end and a button 112 at the other end. In this way, attachment member 100 may be placed adjacent one of the arms of the pillow, with coupling arrangement 106 wrapped around the medial portion of the pillow. In this way, button 112 may be inserted through loop 110 to securely couple attachment member 100 to the pillow.

Figure 6:
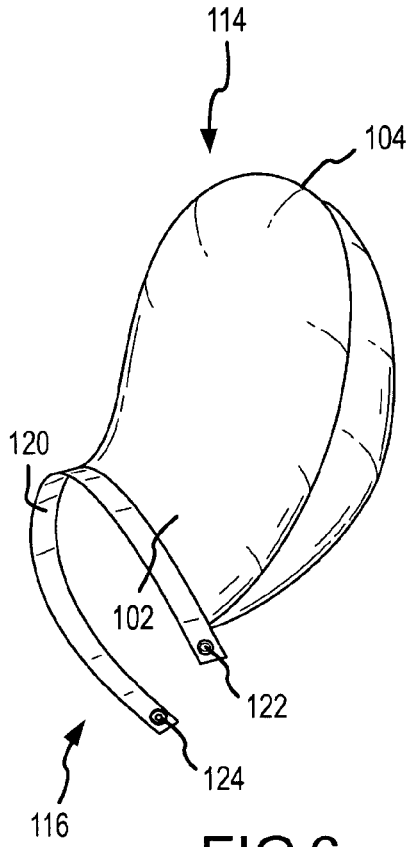
FIG. 6 is a perspective view of another embodiment of an attachment member according to the invention.

FIG. 6 illustrates another embodiment of an attachment member 114 that is similar to attachment member 100 except for the coupling arrangement. As such, the same reference numerals used to describe attachment member 100 will also be used to describe attachment member 114. Attachment member 114 includes a coupling arrangement 116 that comprises a belt 120 having a set of snaps 122 and 124. In this way, attachment member 114 may be attached to a pillow in a manner similar to attachment member 100, with snaps 122 and 124 engaging each other to secure belt 120 around the medial portion of the pillow.

Figure 7:
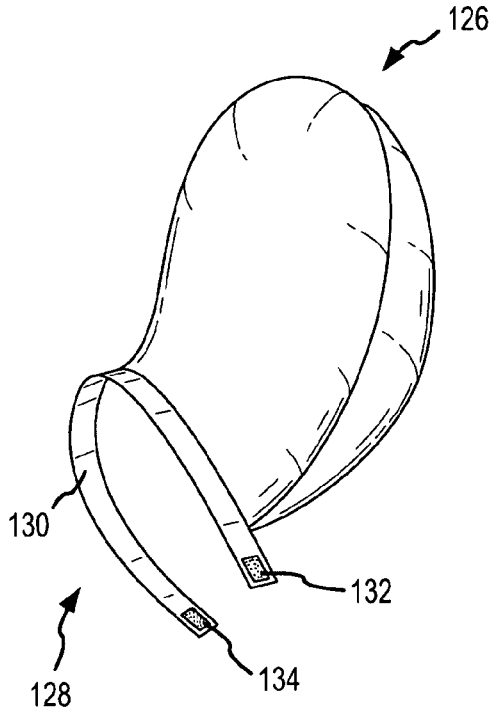
FIG. 7 is a perspective view of still another embodiment of an attachment member according to the invention.

FIG. 7 illustrates another embodiment of an attachment member 126 that is similar to attachment member 100 and will also use the same reference numerals. Attachment member 126 includes a coupling arrangement 128 having a belt 130 with two pieces of a hook and loop fastener material 132 and 134. With such a configuration, attachment member 126 may be coupled to a pillow similar to attachment member 100, with belt 130 being wrapped around the medial portion and the pieces of hook and loop fastener material 132 and 134 being secured to each other.

Figure 8:
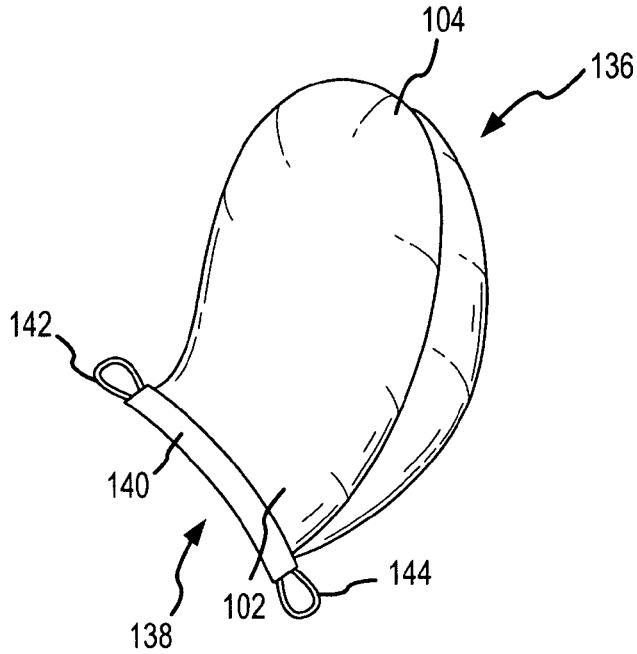
FIG. 8 is a perspective view of yet another embodiment of an attachment member according to the invention.
Figure 9:
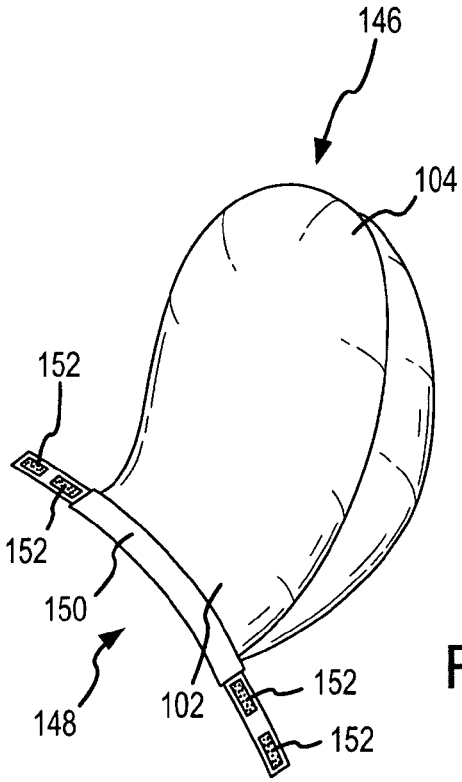
FIG. 9 is a perspective view of still yet another embodiment of an attachment member according to the invention.
Figure 10:
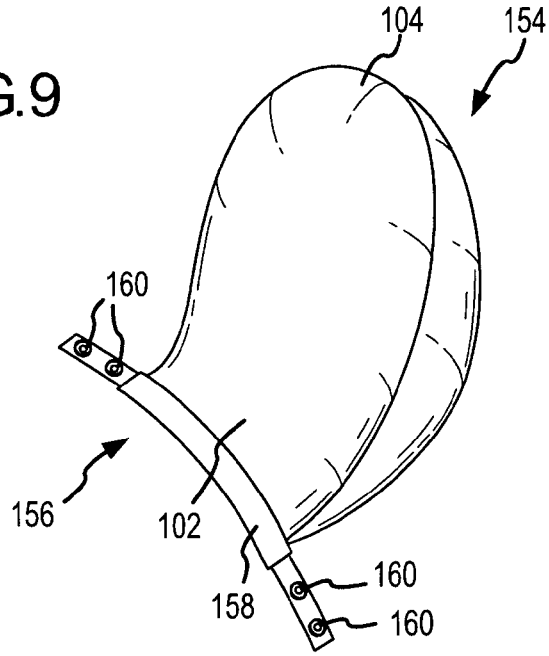
FIG. 10 is a perspective view of one particular embodiment of an attachment member according to the invention.

FIGS. 8-10 illustrate other embodiment of attachment members that are also similar to the attachment members illustrated in FIGS. 5 and 7, except for the coupling arrangements used to couple the attachment members to the pillow. As such, the same reference numerals used in connection with attachment member 100 will also be used in describing the attachment members of FIGS. 8-10. In FIG. 8, an attachment member 136 has a coupling arrangement 138 that comprises a connector 140 having a pair of loops 142 and 144. These loops 142 and 144 are configured to interlock with buttons that are coupled to the support pillow. In this way, attachment member 136 may be placed adjacent one of the arms of the pillow and loops 142 and 144 looped around buttons on the medial region of the pillow.

FIG. 9 illustrates an attachment member 146 having a coupling arrangement 148 that comprises a connector 150 having strips of a hook and loop fastener material 152. Attachment member 146 is configured to be coupled to a pillow in a manner similar to attachment member 136, with the strips 152 interlocking with corresponding strips of a hook and loop fastener material that are directly formed on the pillow.

FIG. 10 illustrates an attachment member 154 having a coupling arrangement 156 that comprises a connector 158 having a set of snaps 160. Hence, attachment member 154 may be coupled to pillow in a manner similar to attachment member 136, with snaps 160 engaging with corresponding snaps that are formed directly on the pillow.

Figure 11:
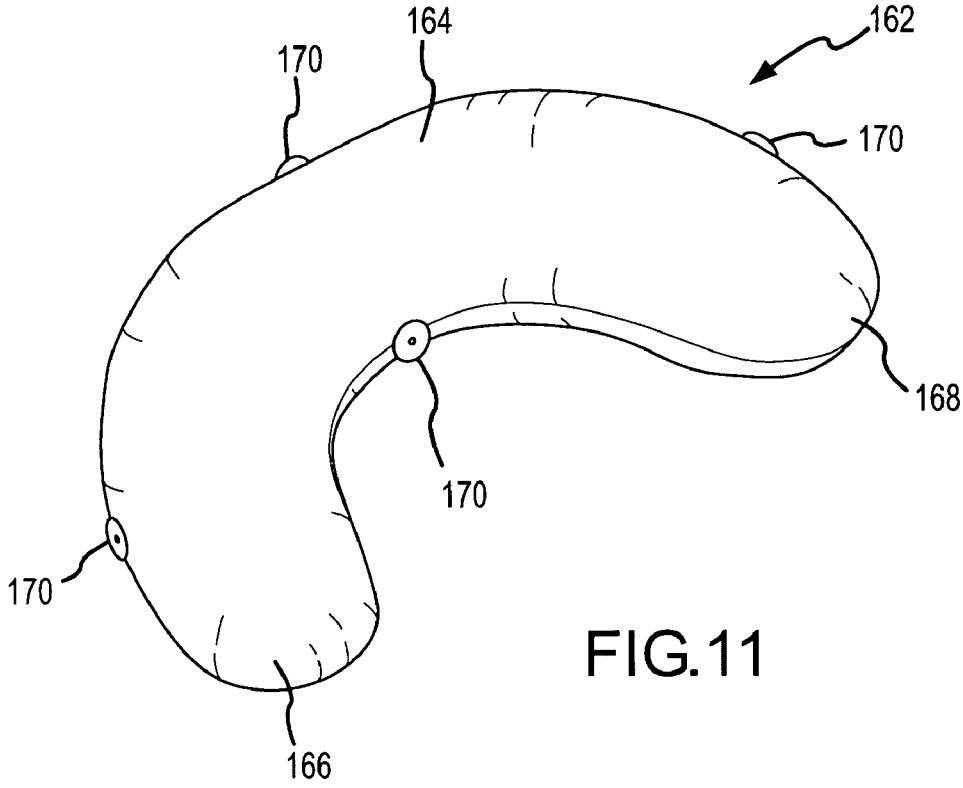
FIG. 11 is a perspective view of one embodiment of a pillow that includes a plurality of connectors that may be used to attach an attachment member to the pillow according to the invention.

FIG. 11 illustrates one embodiment of a support pillow 162 having a medial region 164 and ends 166 and 168. Support pillow 162 may be constructed to be similar to any of the support pillows described herein and will not be described in further detail. Sewn or otherwise attached to pillow 162 are a set of buttons 170 that may be used to couple an attachment member to pillow 162. For example, the attachment member 136 of FIG. 8 may be coupled to pillow 162 by simply looping loops 142 and 144 around buttons 170 that are disposed at medial region 164, and with end 104 aligning generally with end 168. Further, it will be appreciated that only one of the buttons 170 may be used to attach an attachment member to the pillow, or more than one of the buttons 170 may be used.

Figure 12:
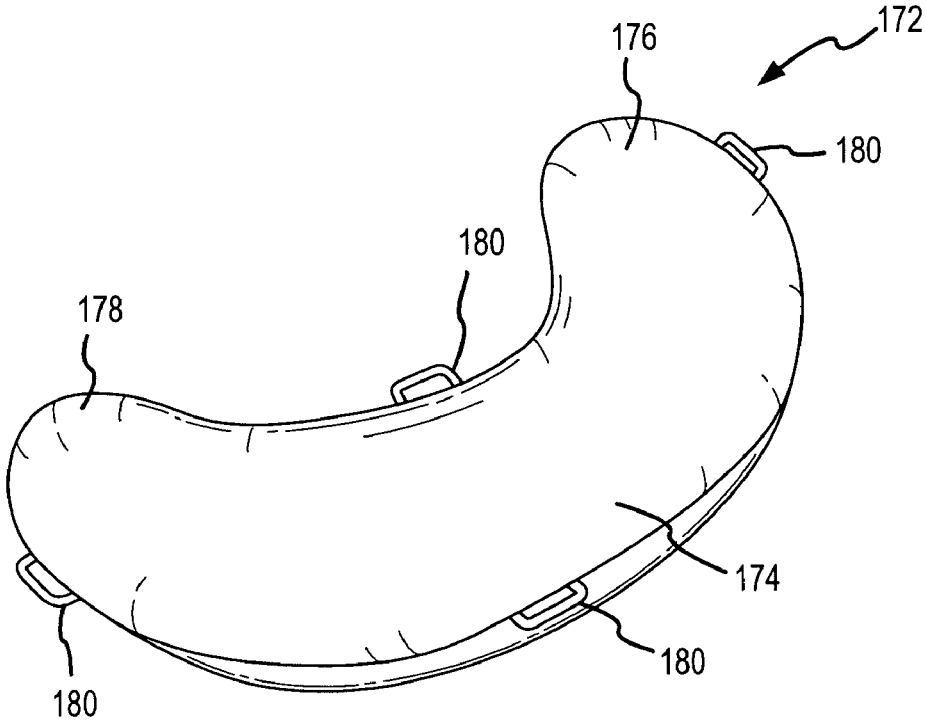
FIG. 12 is a perspective view of another embodiment of a pillow having another set of connectors according to the invention.

FIG. 12 illustrates another embodiment of a support pillow 172 that may also be constructed to be similar to any of the support pillows described herein. Support pillow 172 comprises a medial region 174 and two ends 176 and 178. Disposed along the outer periphery of pillow 172 are fabric loops 180. Loops 180 may be used to couple an attachment member to the pillow 172. For instance, attachment members 100, 114 and 126 may be coupled to pillow 172 by wrapping belts 108, 120 and 130 around medial region 174 while passing through loops 180 before the connectors are engaged. As alternative, pillow 172 could be used with attachment members 146 and 154. For instance, with attachment member 146, connector 150 could be placed around loops 180 at medial region 174, with each end of connector 152 wrapping around the loop 180 and having the two pieces of hook and loop fastener material at each end interlock with each other. In this way, each end of connector 150 will be wrapped around its own loop 180 and coupled to itself using the piece of hook and loop fabric 152. Only one of the loops 180 may be used to couple an attachment member to the pillow, or multiple loops may be used.

Figure 13:
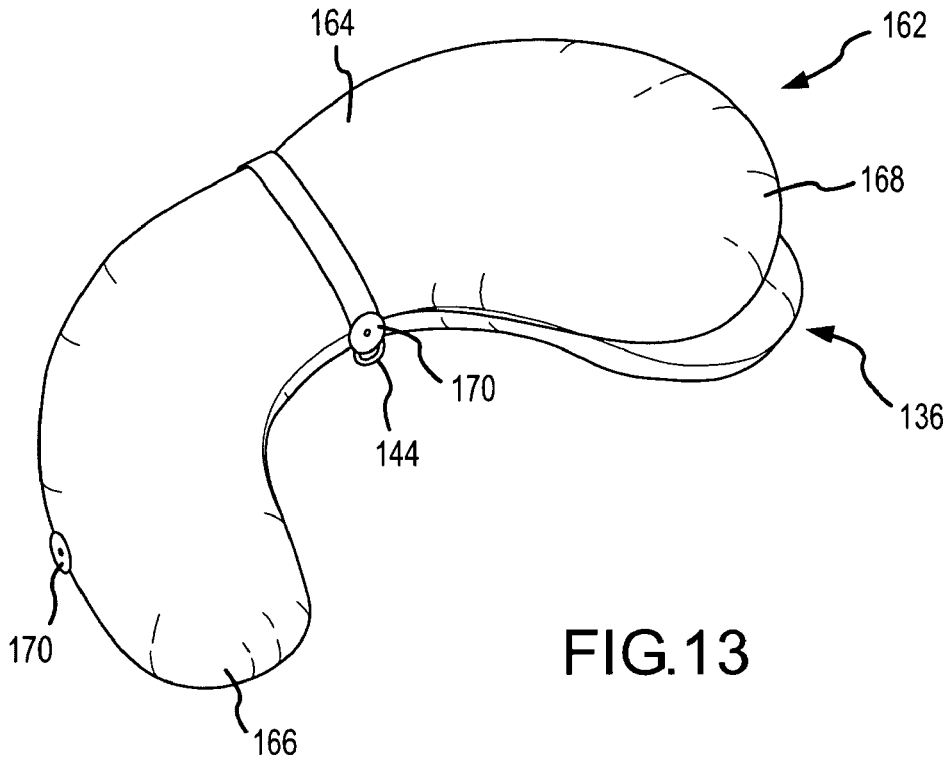
FIG. 13 is a top perspective view of one embodiment of a pillow having an attachment member coupled thereto according to the invention.
Figure 14:
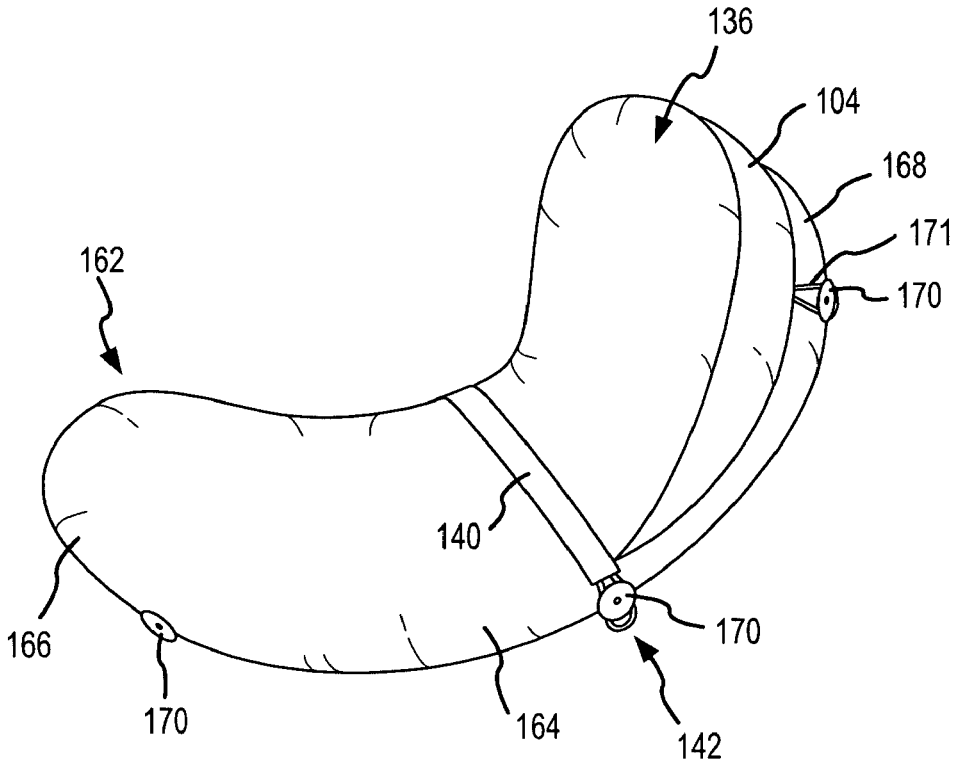
FIG. 14 is a bottom perspective view of the pillow and attachment member of FIG. 13.

FIGS. 13 and 14 illustrate pillow 162 coupled to attachment member 136 of FIG. 8. As shown, loops 142 and 144 are looped around buttons 170 at medial region 164. As an alternative, only one of the buttons 170 may be used, up to all of the buttons 170. For instance, as shown in FIG. 14, attachment 136 may include an optional loop 171 near end 104 that will be connected to another button 170 on pillow 162. In some cases, this button may be the only needed to couple the attachment member to the pillow. As previously described, attachment member 100 may be attached in a similar manner, but in such cases buttons 170 may not be included directly on pillow 162. Instead, connector 108 may be wrapped around medial region 164, with button 112 being inserted through loop 110.

Figure 15:
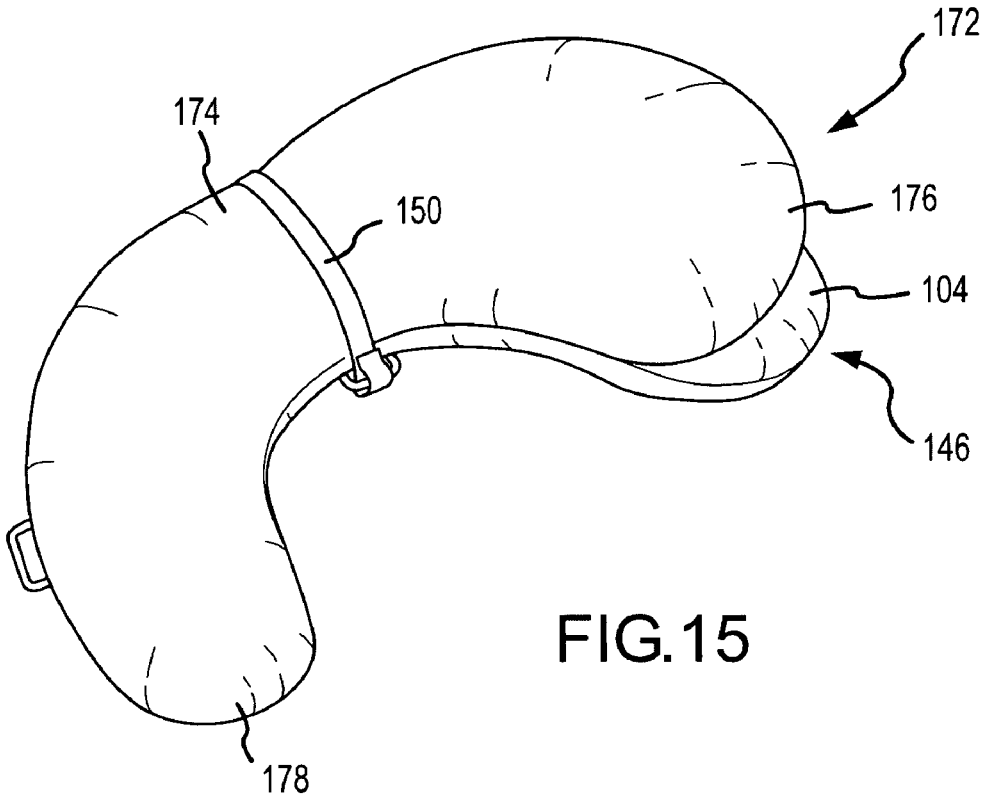
FIG. 15 is a top perspective view of another embodiment of a pillow having an attachment member coupled thereto.
Figure 16:
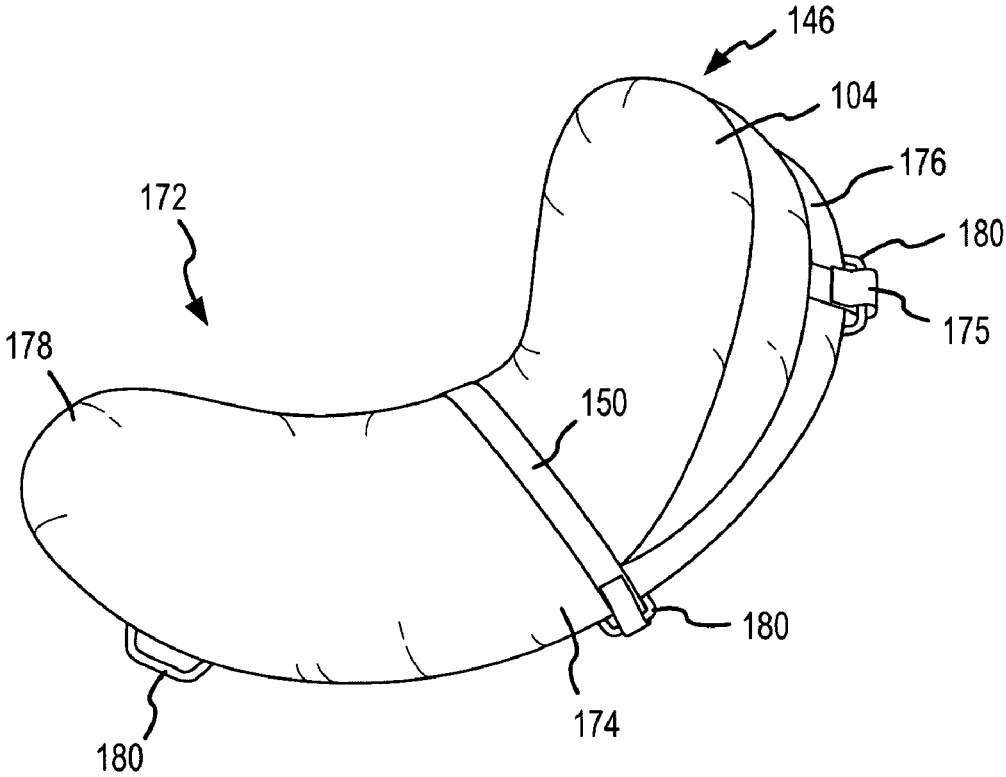
FIG. 16 is a bottom perspective view of the pillow and attachment member of FIG. 15.

FIGS. 15 and 16 illustrate sport pillow 172 that is coupled to attachment member 146 of FIG. 9. As shown, end 104 is configured to generally match with end 176, while connector 150 is placed about medial region 174. Each end of connector 150 is wrapped about one of the loops 180 at medial region 174 and folded back on itself so that the two pieces of hook and loop fastener material engage. Optionally, attachment member 146 may include another connector 175 with pieces of hook and loop fastener material that wrap around loop 180 near end 176 as shown in FIG. 16. This may be the only attachment point needed. As with other embodiments, a single connector may be wrapped around one of the loops, or multiple loops and connectors may be used. Also, it will be appreciated that in an alternative embodiment, attachment member 126 of FIG. 7 may be connected in a similar manner, with connector 130 wrapped entirely about medial region 174 and pieces 132 and 134 interlocked with each other.

Figure 17:
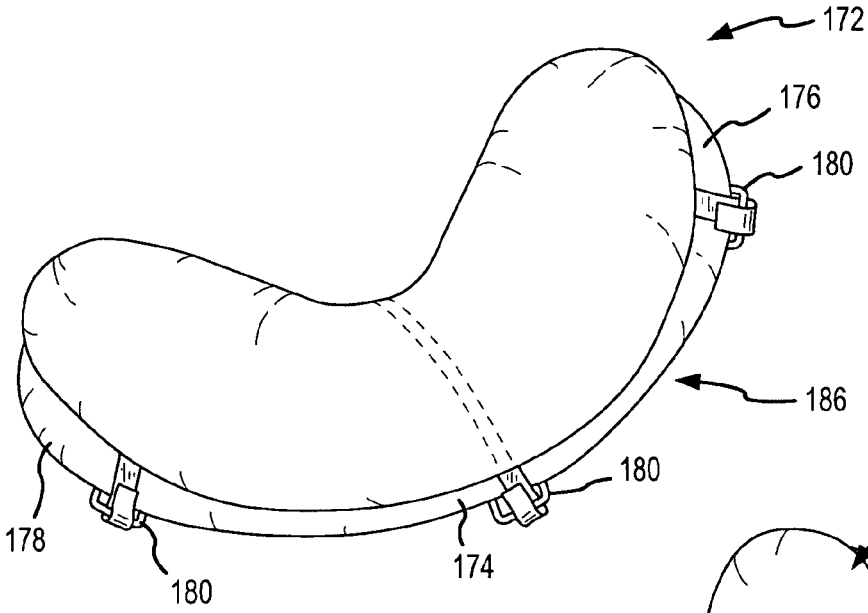
FIG. 17 is a top perspective view of a pillow having an alternative attachment member coupled thereto.
Figure 18:
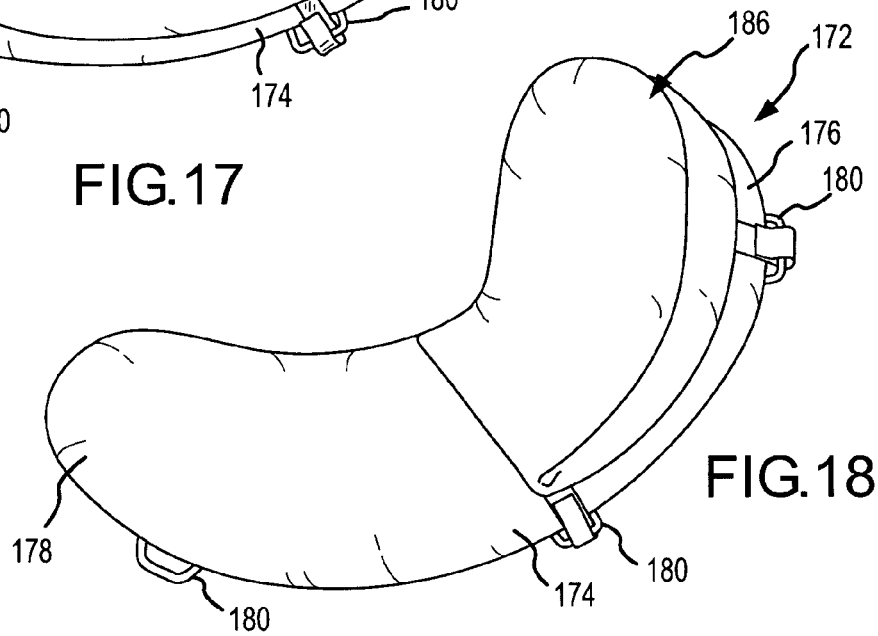
FIG. 18 is a bottom perspective view of the pillow and attachment member of FIG. 17, with the attachment member folded in half according to the invention.
Figure 19:
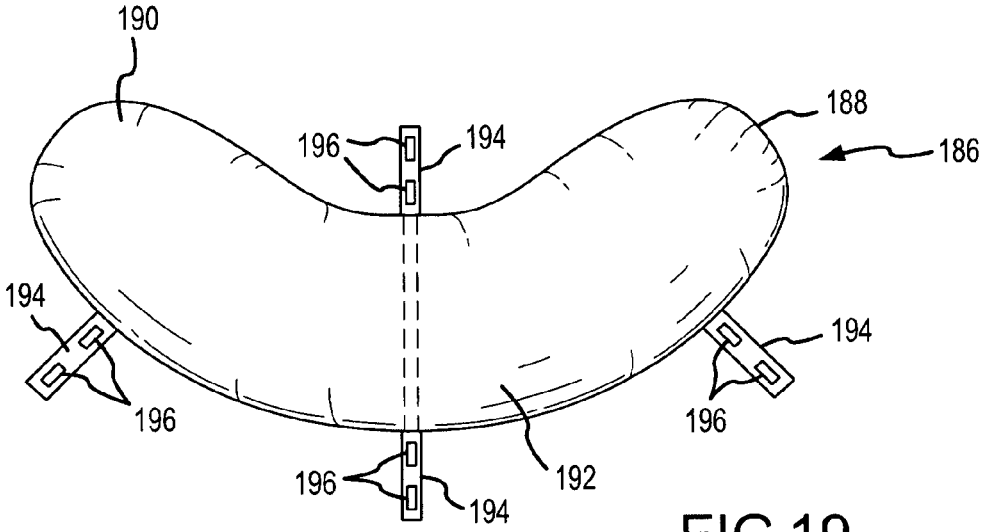
FIG. 19 illustrates the attachment member of FIG. 17 when removed from the pillow.

FIGS. 17 and 18 illustrate support pillow 172 that is coupled to an alternative attachment member 186. As best illustrated in FIG. 19, attachment member 186 has two curved ends 188 and 190 and a medial region 192. Attachment member 186 is curved and generally has the same outer periphery as support pillow 172 (or any of the support pillows described herein). Attachment member 186 may be constructed of a generally resilient fill material that is encased in a shell or fabric covering similar to the other attachment members or support pillows described herein.

Alternatively, attachment member 186 may be constructed of a single piece of material, such as a foam material, inflatable bladder, or the like. Attachment member 186 includes a set of connectors 194 that each include two pieces of a hook and loop fastener material 196. As an alternative to a hook and loop fastener material, it will be appreciated that other connectors could be used, such as snaps, loops, buttons, buckles, and the like. Referring back now to FIG. 17, attachment member 186 may be coupled to support pillow 172 by wrapping connectors 194 around loops 180 and then folding the connectors over themselves until the two pieces of hook and loop fastener material 196 engage with each other. In this way, the entire vertical height of support pillow 172 may be adjusted. Alternatively, the height of one end of attachment member 186 could be made higher than the other end so that the vertical height of the top surface of support pillow 172 may be angled.

As an alternative, attachment member 186 may be folded over itself at medial region 192 as illustrated in FIG. 18. In this way, the vertical height of half of support pillow 172, i.e., at end 176, may be made twice as high. In this way, the top surface of the support pillow 172 will be angled downward when worn on a user's lap.

Figure 20:
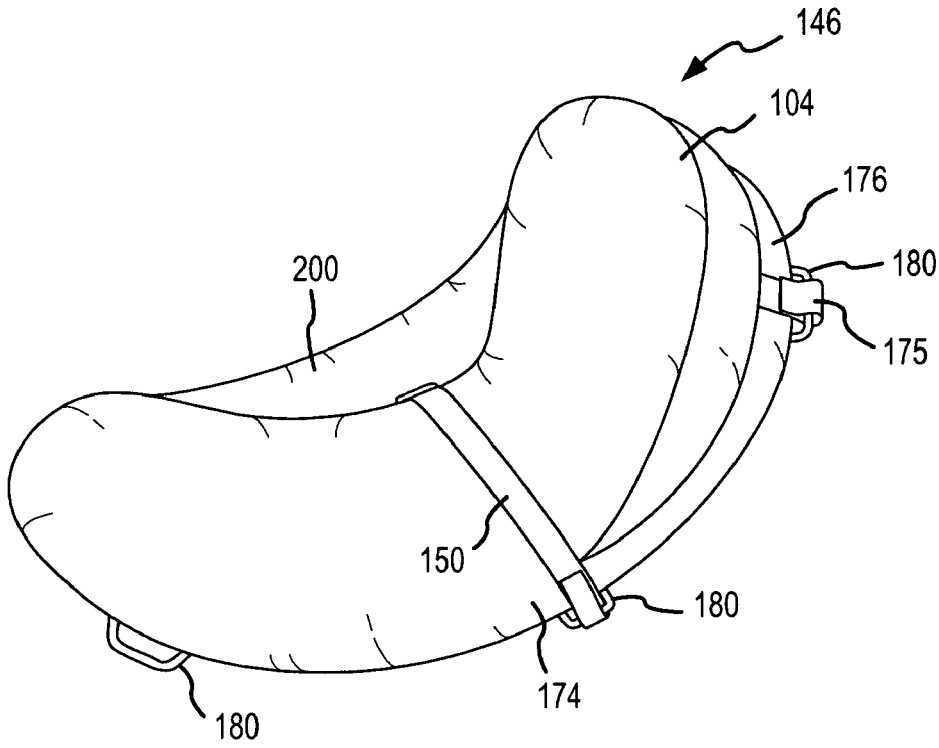
FIG. 20 illustrates the pillow and attachment member of FIG. 18 with a support member according to invention.
Figure 21:
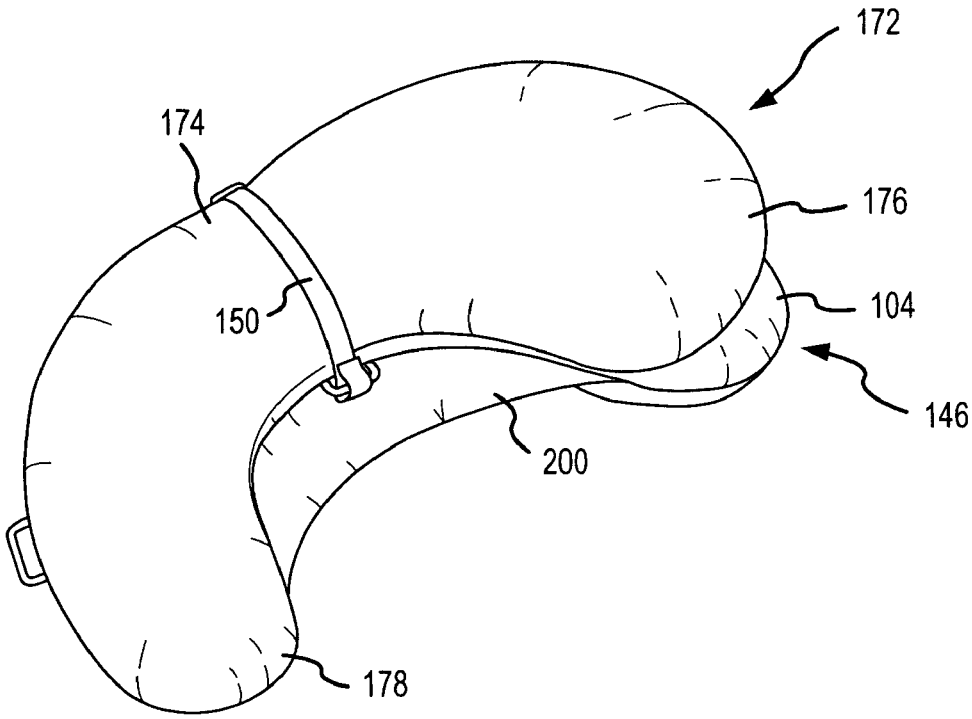
FIG. 21 is a top perspective view of the pillow and attachment member of FIG. 20.

FIG. 20 illustrates support pillow 172 and attachment member 146 along with a support member 200. Support member 200 may be a strip of fabric that is sewn to medial region 174 of pillow 172 at the inner periphery and serves to help support an object that rests on the top surface of pillow 172. Support member 200 may be constructed in a manner similar to the support members described in U.S. Pat. No. 6,763,539, the complete disclosure which is herein incorporated by reference. In some cases, support member 200 could even be attached to attachment member 146 so that attachment member 146 may be used to modify an existing pillow that does not include such a support member.

As a further option, it will be appreciated that a support member similar to support member 200 may be utilized with any of the support pillows described herein. The support member 200 may extend from each of the ends so that it extends across the well region formed along the inner periphery of the pillow.

Figure 22:
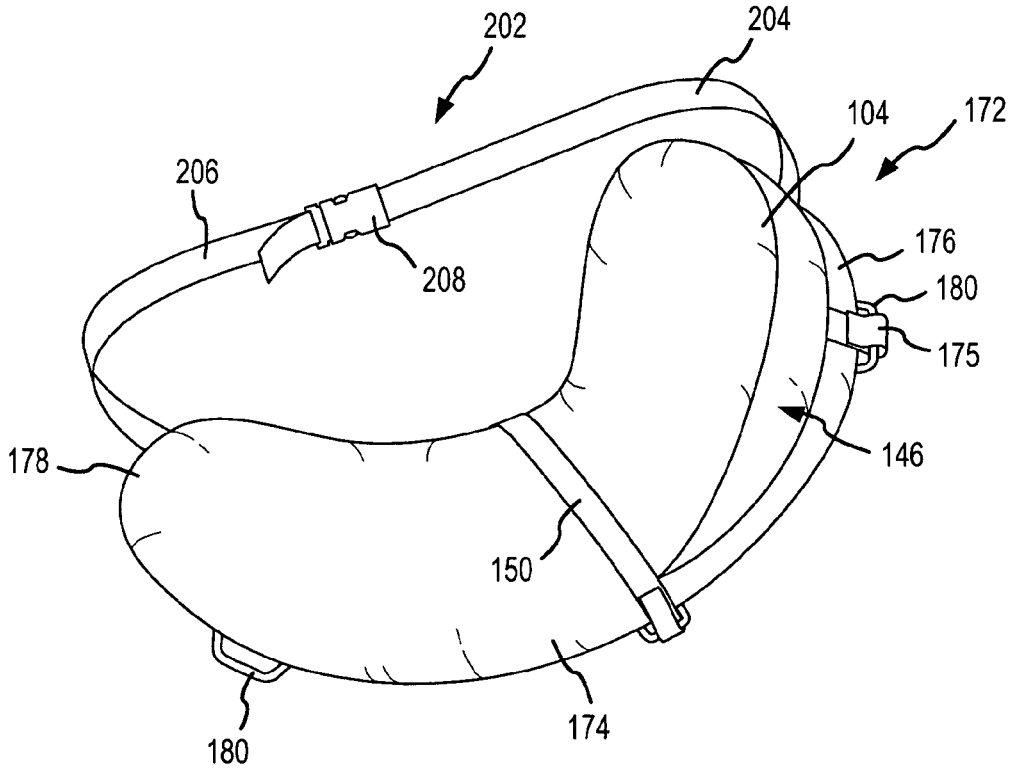
FIG. 22 is a bottom perspective view of the pillow and attachment member of FIG. 18 with an adjustable belt according to the invention.

FIG. 22 illustrates support pillow 172 and attachment member 146 with the addition of an adjustable belt 202. Belt 202 comprises two straps 204 and 206 that are coupled to ends 176 and 178. A connector 208 such as an interconnecting buckle may be used to couple the two straps 204 and 206 together. In use, pillow 172 is placed on a user's lap, with straps 206 and 204 extending around the user's back. Buckle 208 may then be used to secure belt 202 around the user to prevent pillow 172 from shifting around during use.

Although described in connection with pillow 172, it will be appreciated that belt 202 may be used with any of the pillows described herein, and in connection with any of the attachment members described herein.

Figure 23:
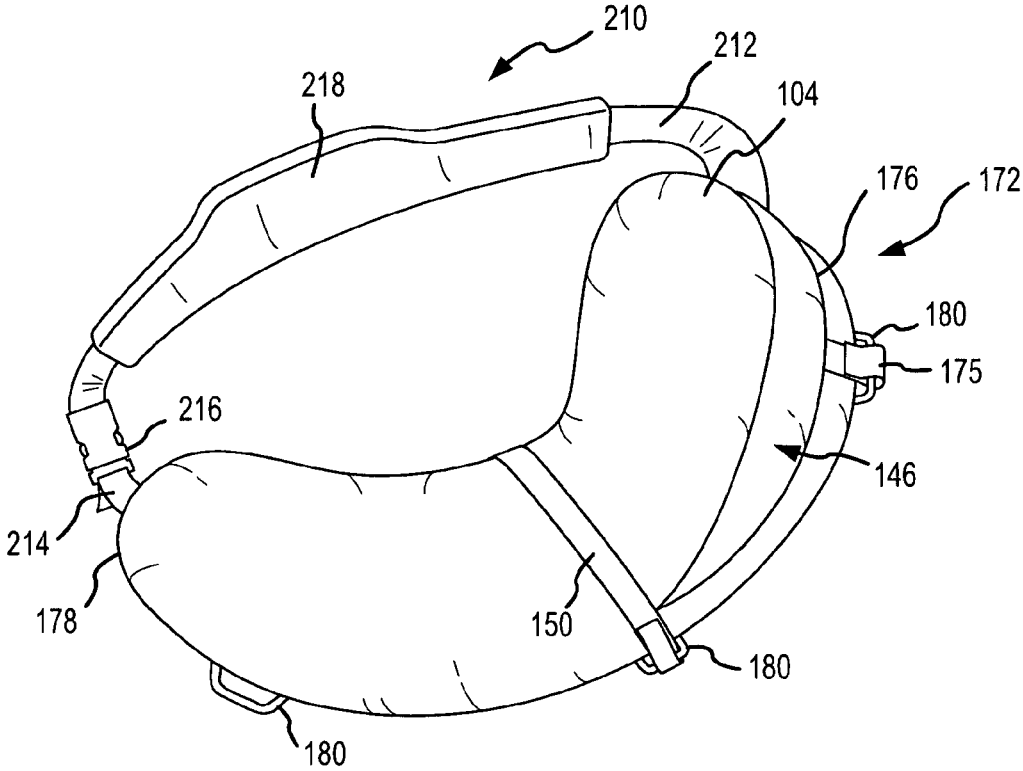
FIG. 23 illustrates the pillow and attachment member of FIG. 18 with an alternative belt according to the invention.

FIG. 23 illustrates pillow 172 and attachment member 146 with an alternative belt 210 that is attached to ends 176 and 178. Belt 210 comprises two straps 212 and 214 that are connected with a connector 216, such as a buckle. Also, strap 212 includes a padded section 218 that is placed against the user's back to provide comfort and support when belt 218 is placed around the user's back. Also, it will be appreciated that belt 210 may be used in connection with any of the pillows or attachment members described herein.

Figure 24:
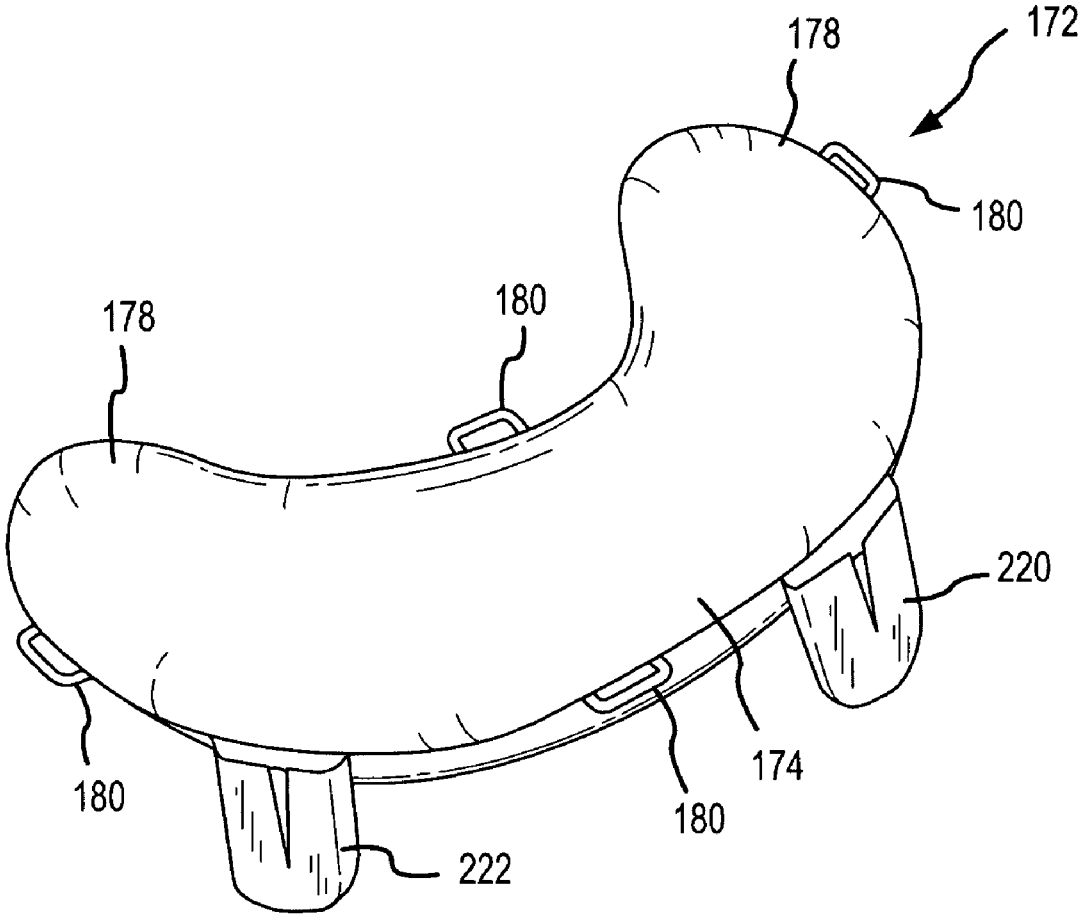
FIG. 24 is a top perspective view of the pillow of FIG. 12 with an arrangement of pockets according to the invention.

FIG. 24 illustrates support pillow 172 that includes a pair of pockets 220 and 222. These pockets are placed on the outer perimeter of the support pillow and may be used to hold a variety of peripheral items, such as bottles, pacifiers, bottles, toys, nursing supplies, ointments, diapers, and the like. Further, it will be appreciated that pockets 220 and 222 may be provided at other locations on the pillow and may have different sizes. Also, different numbers of pockets may be utilized. In some cases, similar pockets could also be provided on any of the attachment members described herein. In a similar manner, pockets 220 and 222 could be included on any of the support pillows described herein.

Figure 25:
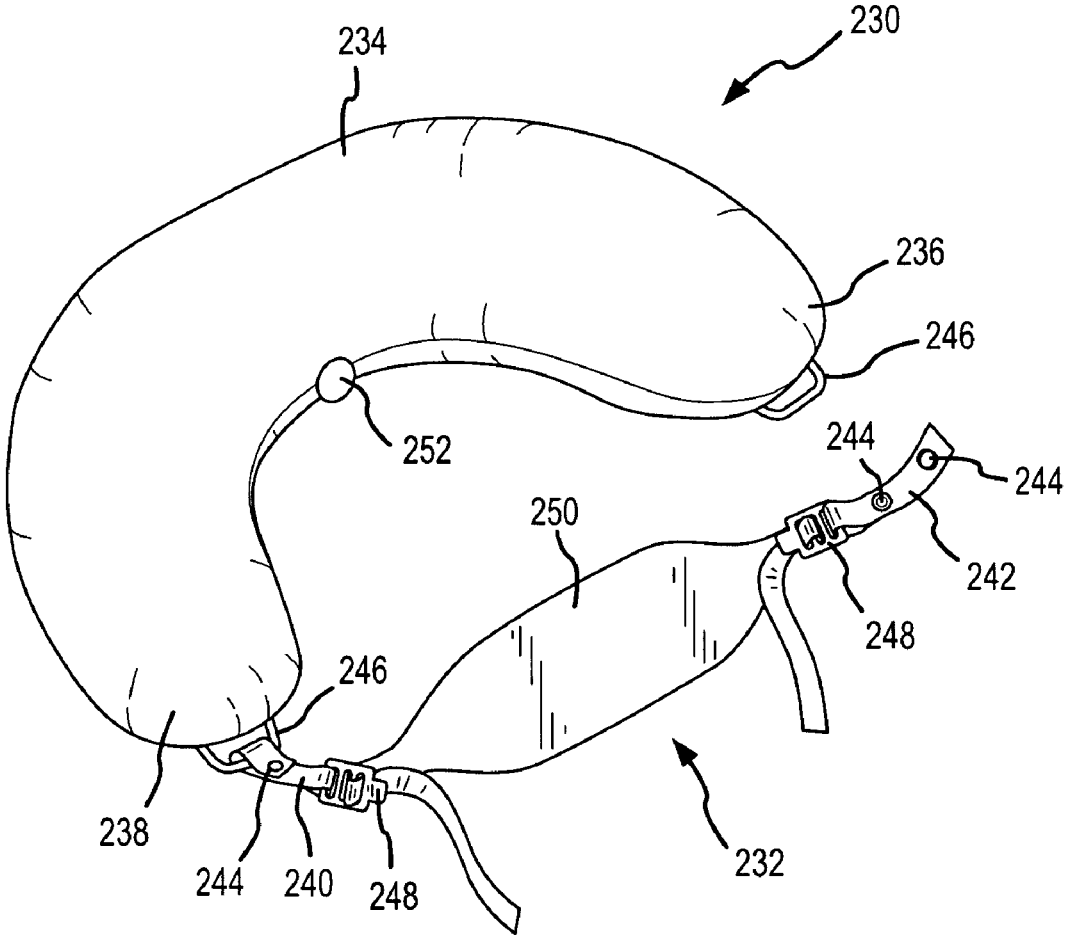
FIG. 25 illustrates one particular embodiment of a pillow with another embodiment of an adjustable belt according to the invention.

FIG. 25 illustrates support pillow 230 with the addition of an adjustable belt 232. Support pillow 230 comprises a medial region 234 and two ends 236 and 238 similar to other embodiments described herein. Belt 232 comprises two straps 240 and 242 that are coupled to ends 238 and 236. A connector 244, such as a pair of snaps is provided on each strap 240 and 242 and may be looped around loops 246 at each end 236 and 238 of pillow 230 and snapped together. Other connectors include any of those described herein. Also, straps 240 and 242 also include a length adjuster 248 having multiple slits that may be used to connect straps 240 and 242 as well as to adjust their length. Belt 232 may also include a padded support region 250 that also includes strap ends that are connected adjusted 248 to permit the length of these ends to be adjusted as well. In use, pillow 234 is placed on a user's lap, with straps 240 and 242 extending around the user's back. Adjuster 248 may then be used to secure belt 232 around the user to prevent pillow 234 from shifting around during use. Also, pillow 234 may include a button 252 or other connectors to attaching to an attachment member similar to other embodiments.

Although described in connection with pillow 234, it will be appreciated that belt 232 may be used with any of the pillows described herein, and in connection with any of the attachment members described herein.

In use, any of the attachment members that are attached to one of the pillows may be placed directly against the user's lap. Alternatively, the attachment members may be placed on the top surface of the pillow which rests on the user's lap so that the object, such as a baby, that is lying on the pillow will directly engage the attachment member.

Any of the pillows described herein may also be used with one or more lower back pillows. Such lower back pillows may be permanently or removably attached to the main pillow. In this way, when the main pillow rests on the user's lap, the arms of the main pillow will be adjacent the user's sides, and the lower back pillow will be placed against the user's lower back. If sitting in a chair, the lower back pillow will rest between the back of the chair and the user's back to provide support to the lower back. The manner in which the lower back pillow is attached to the main pillow may be adjustable so that the lower back pillow will contact the appropriate position on the lower back while the main pillow is on the user's lap and snug about a the user's stomach and sides. Also, the size and shape of the lower back pillow may be varied according to the size and shape of the user as well as for any back ailments. For example, the lower back pillow could be rectangular, oval, round, kidney bean shaped or the like. Also, the lower back pillow may be constructed using any of the materials and/or techniques used to construct the main pillow.

Figure 26:
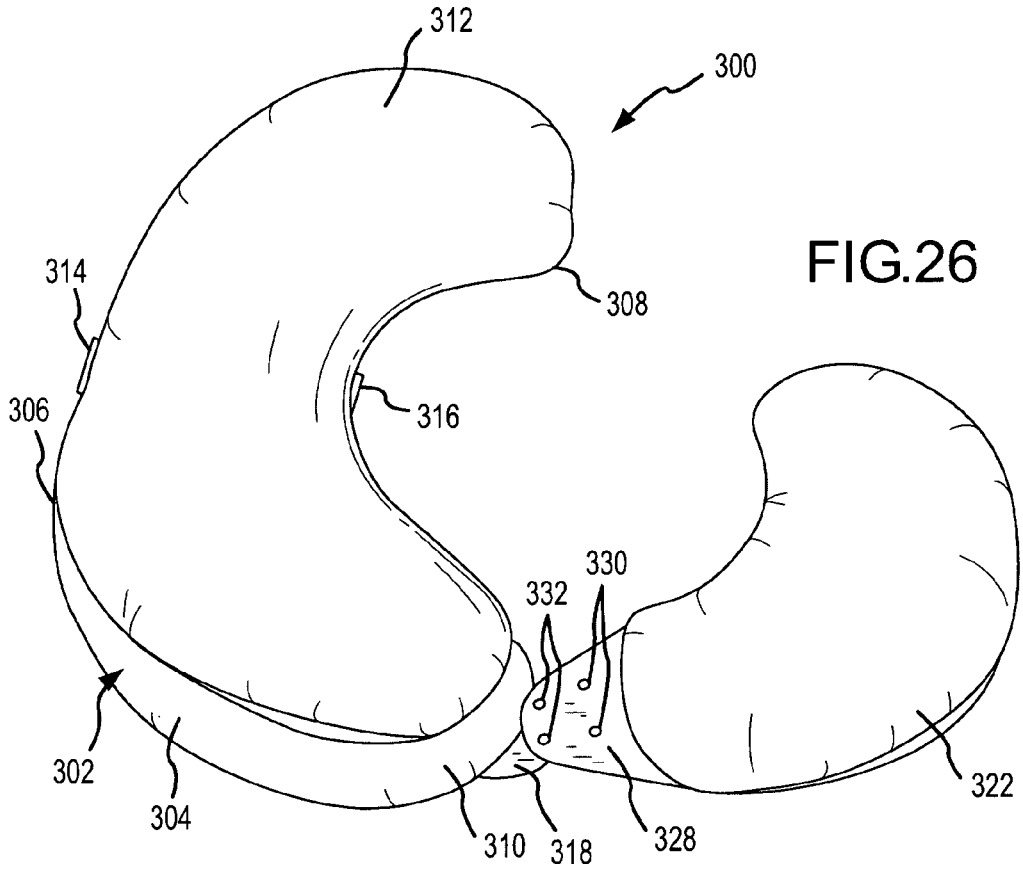
FIG. 26 illustrates an embodiment of a pillow system having a main pillow, a lower back pillow and an attachment member according to the invention.
Figure 27:
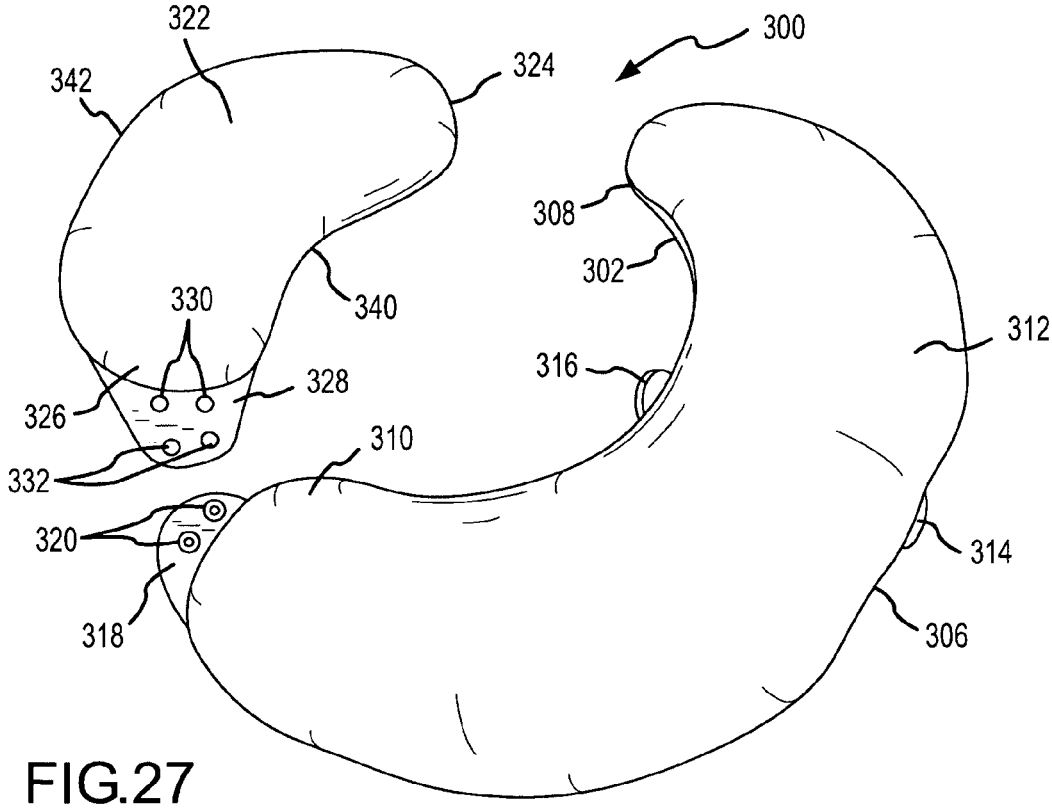
FIG. 27 illustrates the main pillow and lower back pillow of FIG. 26 when separated from each other.

Referring now to FIGS. 26 and 27, one embodiment of a pillow system 300 will be described. System 300 comprises a main pillow 302 that comprises a pillow body 304 having a medial region 306 and two ends 308 and 310. Main pillow 300 may be constructed using the same dimensions and/or materials as any of the pillows described herein. Optionally, a removable padded attachment member 312 may be attached to a main pillow 302. Padded attachment member 312 may be constructed in a manner similar to any of the padded attachment members described herein and may be removably attached to the main pillow using any of the attachment schemes described herein. As shown, main pillow 302 includes buttons 314 and 316 over which loops (not shown) on attachment member 312 engage.

End 310 includes a fabric extension 318 that includes a pair of snaps 320 that permit main pillow 302 to be removably coupled to a lower back pillow 322. More specifically, lower back pillow includes a pair of ends 324 and 326, one of which includes a fabric extension 328 having two sets of snaps 330 and 332. In this way, lower back pillow 332 may be removably attached to main pillow 302 by snapping snaps 330 or 332 into snaps 320 of main pillow 302. The use of two pairs of snaps permits the distance between lower back pillow 322 and main pillow 302 to be adjusted. In this way, the position of lower back pillow 322 relative to the user's lower back may be adjusted so that main pillow 302 may be positioned against the user's stomach and sides described herein. This is particularly useful in that it allows one size of main pillow and lower back pillow to be used with a variety of users of different sizes.

Although described with snaps, it will be appreciated that a wide variety of other attachment schemes may be used, such as buttons, a hook and loop fastener material, ties and the like. Further, although shown attached to end 310, it will be appreciated that lower back pillow 322 could be attached to end 308 or to both ends 308 and 310. Also, other attachment schemes could be used other than by using fabric extensions, such as by use of ties.

Lower back pillow 322 is kidney bean shaped in geometry. This configuration permits the inner periphery 340 of pillow 322 to be placed about the user's lower back, generally conforming to the shape of the back. The outer periphery can rest against a support surface, such as the back of a chair, a wall or the like. In one particular embodiment, lower back pillow 322 may have a length from end 324 to end 326 that is in the range from about 10 inches to about 30 inches. Flap 328 may have a length in the range from about 1 inch to about 6 inches, and snaps 330 may be spaced from snaps 332 by a distance in the range from about 1 inch to about 4 inches. Lower back pillow 332 may have a vertical height in the range from about 2 inches to about 6 inches and a width (from inner periphery 340 to outer periphery 342) in the range from about 6 inches to about 12 inches.

Lower back pillow 322 may be constructed of a fabric shell that encases a fill material similar to the other pillows described herein. Optionally, a removable cover could also be placed about the pillow and may include attachments for attaching lower back pillow 322 to main pillow 302.

In use, main pillow 302 may be placed on a user's lap while sitting, with ends 308 and 310 extending around the user's sides. If desired, padded attachment member 312 may be used to increase the height and/or vary the angle of the top surface similar to other embodiments. Lower back pillow 322 is also placed against the user's lower back. One particular application is when nursing a baby. In this way, the main pillow and optionally the padded attachment may be used to support the baby while the mother is sitting. At the same time, lower back pillow 322 supports the mother's lower back. If desired, lower back pillow 322 can simply be removed.

Figure 28:
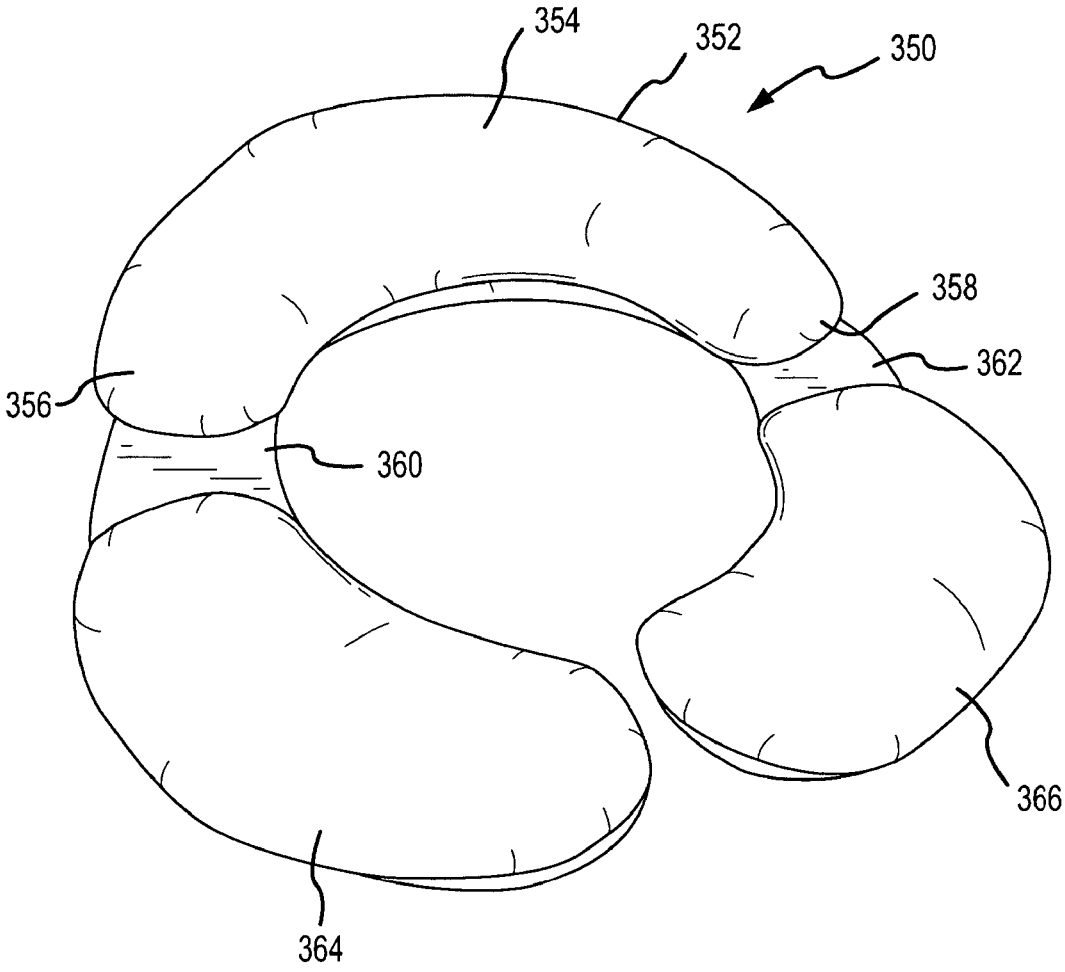
FIG. 28 illustrates another embodiment of a pillow system having a main pillow and two attached pillows according to the invention.

Referring now to FIG. 28, another embodiment of a pillow system 350 will be described. Pillow system 350 comprises a main pillow 352 having a medial region 354 and a pair of ends 356 and 358. Main pillow 352 may be constructed similar to any of the pillows described herein. Optionally, main pillow 352 could also be used with any of the padded attachment members described herein. Ends 356 and 358 each include a fabric extension 360 and 362 that attach main pillow 352 to a pair of lower back pillows 364 and 366. In this way, pillows 364 and 366 are permanently attached to main pillow 352. However, it will be appreciated that lower back pillows 364 and 366 could be removably attached in a manner similar to other embodiments described herein. Also, although shown with two lower back pillows, it will be appreciated that only a single lower back pillow could be attached.

Pillow system 350 has a variety of uses. In one application, both lower back pillows 364 and 366 could be placed adjacent the lower back while main pillow 352 is at the user's stomach. In another application, one or both of lower back pillows 364 or 366 could be folded over so as to rest on top of or below main pillow 352. In this way, one or both of the lower back pillows could be used to vary the height and/or angle of the main pillow. Or, one could be used to vary the height of the main pillow while the other supports the lower back.

The lower back pillows 364 and 366 may have a size and shape that are similar to the other back support pillows described herein. Alternatively the lower back pillow could be smaller in size or have different shapes so that both could fit behind the back in tandem.

The invention has now been described in detail for purposes of clarity and understanding. However it will be appreciated that certain changes and modifications may be practiced within the scope of the appended claims.

What is claimed is:

1. A pillow system comprising:

a curved main pillow comprising a pillow body having a midsection, an outer periphery, an inner periphery and a pair of ends configured such that the main pillow is positionable on a user's lap, with the inner periphery adjacent the user's stomach and the ends wrapped about the user's sides;

a curved lower back pillow operably attached to one of the ends of the main pillow such that the back pillow is positionable at the user's back when the main pillow is placed adjacent to the user's stomach;

a piece of fabric connected to one end of the curved main pillow and an end of the lower back pillow such that the curved main pillow and curved lower back pillow form a substantially continuous concave shape for the inner periphery, the piece of fabric having a length of about 1 inch to about 6 inches; and wherein the lower back pillow has a vertical height in the range from about 2 inches to about 6 inches and a width from an inner periphery which contacts the user's back to an outer periphery in the range from about 6 inches to about 12 inches in order to provide lower back support.

2. A pillow system as in claim 1, wherein the lower back pillow has a pair of ends, wherein at least one of the ends of the lower back pillow includes a connector, wherein one of the ends of the main pillow includes a connector that mates with the connector on the lower back pillow such that the lower back pillow and the main pillow may be removably coupled to each other.

3. A pillow system as in claim 2, wherein the lower back pillow and the main pillow each include a fabric extension at one of their ends to which the connectors are coupled.

4. A pillow system as in claim 2, wherein the connector on the lower back pillow and the connector on the main pillow are selected from a group of connectors consisting of snaps, hook and loop fastener materials, ties and buttons.

5. A pillow system as in claim 1, wherein the lower back pillow is kidney bean shaped in geometry.

6. A pillow system as in claim 1, further comprising a padded attachment member that is removably attachable to the pillow body of the main pillow, wherein the attachment member has a certain height to permit the height of at least a portion of the pillow body to be adjusted relative to a support surface when the attachment member is attached to the pillow body.

7. A pillow system as in claim 6, wherein the attachment member has a shape that generally matches the shape of the pillow body and has a flexible midportion that permits the attachment member to be folded in half.

8. A pillow system as in claim 6, wherein the attachment member has a height in the range from about 1 inch to about 5 inches.

9. A pillow system as in claim 6, further comprising a coupling arrangement to removably attach the attachment member to the pillow body.

10. A pillow system as in claim 9, wherein the coupling arrangement comprises a first connector attached to the attachment member and a second connector attached to the pillow body.

11. A pillow system as in claim 6, wherein the attachment member, the main pillow and the lower back pillow each comprise a fill material enclosed within a fabric shell.

12. A pillow system as in claim 1, wherein the pillow body of the main pillow has an average radius of curvature in the range from about 6 inches to about 16 inches, wherein the pillow has a length from one end to the other end in the range from about 21 inches to about 42 inches, and wherein the pillow body is both firm and flexible to permit the pillow body to be wrapped about a user.

13. A pillow system as in claim 1, wherein the midsection of the pillow body of the main pillow has an average width in the range from about 5 inches to about 10 inches, an average height in the range from about 4 inches to about 9 inches, wherein the ends of the main pillow have an average width in the range from about 3 inches to about 10 inches and an average height in the range from about 1 inch to about 9 inches, and wherein the ends of the main pillow are spaced apart from each other in the range from about 14 inches to about 28 inches.

14. A method for supporting an item, comprising:

providing a curved main pillow comprising a pillow body having a midsection, an outer periphery, an inner periphery and a pair of ends, and a curved lower back pillow operably attached to one of the ends of the main pillow such that the curved main pillow and curved lower back pillow form a substantially continuous concave shape for the inner periphery;

placing the main pillow onto a lap of a user who is sitting down, with the midsection being adjacent the user's stomach and with the ends extending around the user's sides;

positioning the lower back pillow adjacent to the user's lower back; and supporting an item using the main pillow;

wherein the lower back pillow has a vertical height in the range from about 2 inches to about 6 inches and a width from an inner periphery which contacts the user's back to an outer periphery in the range from about 6 inches to about 12 inches.

15. A method as in claim 14, further comprising coupling an attachment member to the main pillow body, with the attachment member contacting the user's lap or resting on a top surface of the pillow body so as to adjust the height of the pillow body relative to the user's lap, and wherein the item comprises a baby, and further comprising nursing or feeding the baby while being supported by the pillow.

16. A method as in claim 14, further comprising detaching the lower back pillow from the main pillow and reattaching the lower back pillow to the main pillow at a different location on the main pillow.

17. A method as in claim 14, wherein the lower back pillow and the main pillow are operably attached with a piece of fabric having a length of about 1 inch to about 6 inches.

18. A pillow system comprising:

a curved main pillow comprising a pillow body having a midsection, an outer periphery, an inner periphery and a pair of ends configured such that the main pillow is positionable on a user's lap, with the inner periphery adjacent the user's stomach and the ends wrapped about the user's sides;

a curved lower back pillow operably attached to one of the ends of the main pillow such that the back pillow is positionable at the user's back when the main pillow is placed adjacent to the user's stomach such that the curved main pillow and curved lower back pillow form a substantially continuous concave shape for the inner periphery;

wherein a piece of fabric connects to one end of the curved main pillow and an end of the lower back pillow, and wherein the main pillow, the piece of fabric and the lower back pillow form a continuous curve such that when the main pillow is placed against a user's stomach, the piece of fabric extends around the user's side and the lower back pillow is adjacent the user's back.

19. A pillow system as in claim 18, wherein the lower back pillow and the main pillow are operably attached with a piece of fabric having a length of about 1 inch to about 6 inches; and wherein the lower back pillow has a vertical height in the range from about 2 inches to about 6 inches and a width from an inner periphery which contacts the user's back to an outer periphery in the range from about 6 inches to about 12 inches.

* * * * *